US008973171B2

(12) United States Patent
Cleva

(10) Patent No.: US 8,973,171 B2
(45) **Date of Patent: *Mar. 10, 2015**

(54) FORM-FITTING PROTECTIVE HEADWEAR

(71) Applicant: Robert E. Cleva, Port Washington, NY (US)

(72) Inventor: Robert E. Cleva, Port Washington, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/962,568

(22) Filed: Aug. 8, 2013

(65) Prior Publication Data

US 2013/0318690 A1 Dec. 5, 2013

Related U.S. Application Data

(63) Continuation-in-part of application No. 13/531,065, filed on Jun. 22, 2012, now Pat. No. 8,689,365, which is a continuation of application No. 13/362,834, filed on Jan. 31, 2012, now Pat. No. 8,458,820, which is a (Continued)

(51) Int. Cl.

| | |
|---|---|
| ***A42B 3/00*** | (2006.01) |
| ***A42B 3/12*** | (2006.01) |
| ***A42B 1/08*** | (2006.01) |

(52) U.S. Cl.

CPC .. *A42B 3/125* (2013.01); *A42B 1/08* (2013.01)
USPC ..... 2/411; 2/414; 2/181

(58) Field of Classification Search

USPC ..... 2/410, 411, 413, 425, 175.3, 195.1, 2/171, 175.1, 175.5, 181, 183, 195.3, 2/195.8

See application file for complete search history.

(56) References Cited

U.S. PATENT DOCUMENTS

| | | | |
|---|---|---|---|
| 1,187,656 | A | 6/1916 | Sargent |
| 2,926,356 | A | 3/1960 | Taylor |
| 3,872,511 | A | 3/1975 | Nichols |
| 4,441,211 | A | 4/1984 | Donzis |

(Continued)

FOREIGN PATENT DOCUMENTS

| | | |
|---|---|---|
| EP | 0048442 | 3/1982 |
| GB | 2389299 | 12/2003 |

(Continued)

OTHER PUBLICATIONS

Auction of "Brooklyn Dodgers Cap Attributed to Jackie Robinson—With Custom Protective Inserts", http://www.scpauctions.com, SCP Auctions, Nov. 2010, Internet Auction.

(Continued)

*Primary Examiner* — Katherine Moran
(74) *Attorney, Agent, or Firm* — Hoffmann & Baron, LLP

(57) ABSTRACT

Protective headwear includes a body, band, cuff, and plurality of inserts. The body has an opening and a crown, and is configured to fit a head of a person. The band extends about the opening to an interior of the body and partially toward the crown. The band is free floating with respect to the body and configured to fit the head of the person. The band includes a plurality of pockets disposed about a base stitching that secures the band to the body. The cuff extends about the body and away from the crown, and incorporates a cuff element. The inserts are configured to be received into the pockets to provide a protective function to the head of the person. The inserts are disposed adjacently to one another about the band and extend from the base stitching of the band to the crown of the body.

17 Claims, 13 Drawing Sheets

Related U.S. Application Data continuation-in-part of application No. 13/231,434, filed on Sep. 13, 2011, now Pat. No. 8,347,419.

(60) Provisional application No. 61/580,949, filed on Dec. 28, 2011, provisional application No. 61/584,896, filed on Jan. 10, 2012.

(56) References Cited

U.S. PATENT DOCUMENTS

| | | | | |
|---|---|---|---|---|
| 4,566,137 | A | | 1/1986 | Gooding |
| 4,586,200 | A | | 5/1986 | Poon |
| 5,228,143 | A | * | 7/1993 | Marchello ..... 2/425 |
| 5,405,312 | A | | 4/1995 | Jacobs |
| RE35,193 | E | | 4/1996 | Shifrin |
| 5,615,415 | A | | 4/1997 | Beckerman |
| 5,661,854 | A | | 9/1997 | March, II |
| 5,720,051 | A | | 2/1998 | Johnson |
| 5,729,830 | A | * | 3/1998 | Luhtala ..... 2/2.5 |
| 5,815,846 | A | | 10/1998 | Calonge |
| 5,882,205 | A | | 3/1999 | Peterson |
| 5,890,232 | A | | 4/1999 | Park |
| 5,913,412 | A | | 6/1999 | Huber et al. |
| 5,946,734 | A | | 9/1999 | Vogan |
| 5,960,477 | A | * | 10/1999 | Dixon ..... 2/195.1 |
| 6,012,162 | A | | 1/2000 | Bullat |
| 6,065,158 | A | | 5/2000 | Rush, III |
| 6,073,271 | A | | 6/2000 | Alexander et al. |
| 6,122,785 | A | | 9/2000 | Bondie et al. |
| 6,131,196 | A | | 10/2000 | Vallion |
| 6,175,967 | B1 | | 1/2001 | Donzis |
| 6,178,560 | B1 | | 1/2001 | Halstead et al. |
| 6,226,801 | B1 | | 5/2001 | Alexander et al. |
| 6,253,376 | B1 | | 7/2001 | Ritter |
| 6,282,724 | B1 | | 9/2001 | Abraham et al. |
| 6,438,761 | B1 | | 8/2002 | McGarrity |
| 6,493,881 | B1 | | 12/2002 | Picotte |
| 6,625,820 | B1 | * | 9/2003 | Lampe ..... 2/425 |
| 6,811,463 | B2 | | 11/2004 | Martz |
| 6,904,617 | B2 | | 6/2005 | Tsai |
| 7,089,602 | B2 | | 8/2006 | Talluri |
| 7,213,271 | B1 | | 5/2007 | Bielefeld |
| 7,673,350 | B2 | | 3/2010 | Mazzoccoli et al. |
| 7,814,573 | B1 | * | 10/2010 | Greenberg ..... 2/181 |
| 7,900,271 | B2 | | 3/2011 | Sonner |
| 7,937,778 | B1 | * | 5/2011 | Norton ..... 2/414 |
| 8,347,419 | B1 | * | 1/2013 | Cleva ..... 2/410 |
| 8,548,820 | B2 | * | 10/2013 | Matz et al. ..... 705/1.1 |
| 2001/0032351 | A1 | | 10/2001 | Nakayama et al. |
| 2001/0034895 | A1 | | 11/2001 | Ikeda |
| 2003/0233697 | A1 | | 12/2003 | Tsai |
| 2004/0093658 | A1 | | 5/2004 | Jackson |
| 2005/0241048 | A1 | | 11/2005 | Cattaneo |
| 2006/0059606 | A1 | | 3/2006 | Ferrara |
| 2007/0056081 | A1 | | 3/2007 | Aspray |
| 2007/0094769 | A1 | | 5/2007 | Lakes et al. |
| 2007/0190292 | A1 | | 8/2007 | Ferrara |
| 2008/0250548 | A1 | | 10/2008 | Stuhmiller et al. |
| 2009/0265839 | A1 | | 10/2009 | Young et al. |
| 2010/0167042 | A1 | | 7/2010 | Ervasti |
| 2010/0192290 | A1 | | 8/2010 | Husain |
| 2011/0203036 | A1 | | 8/2011 | Turner et al. |

FOREIGN PATENT DOCUMENTS

| | | |
|---|---|---|
| GB | 2423006 | 8/2006 |
| WO | 2005000057 A2 | 1/2005 |

OTHER PUBLICATIONS

International Search Report and Written Opinion issued in PCT/US2012/020794 on May 2, 2012.
European Search Report issued in EP 12718556 on Jun. 19, 2013.

* cited by examiner

Fig. 13
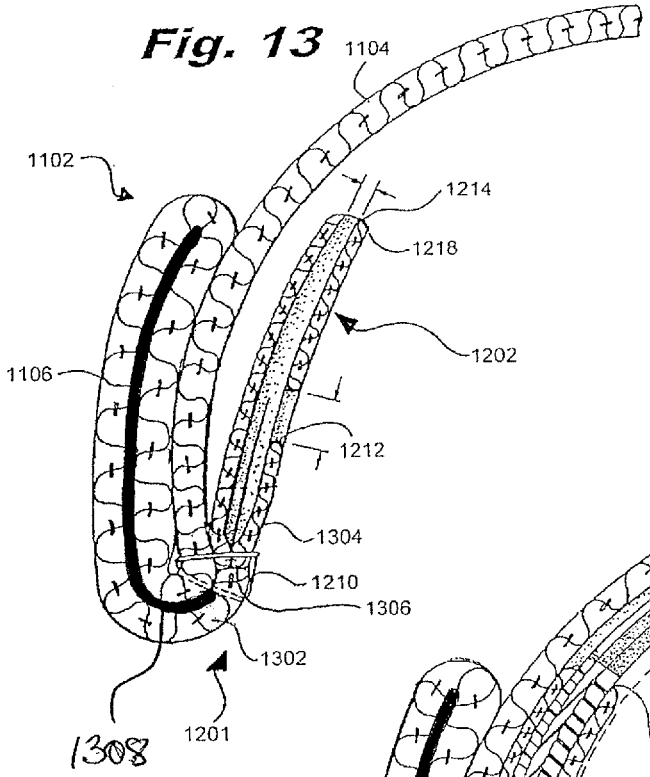
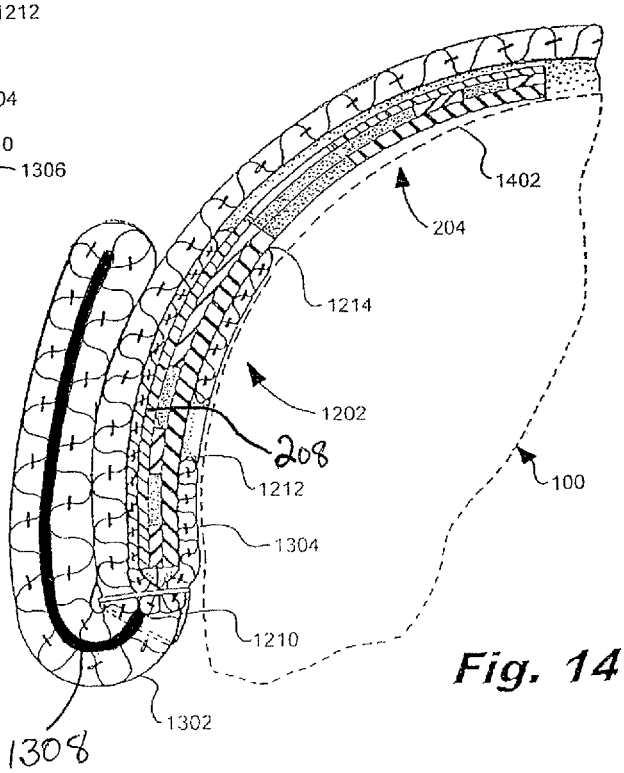
Fig. 14

FORM-FITTING PROTECTIVE HEADWEAR

CROSS-REFERENCE TO RELATED APPLICATION

This application is a continuation-in-part of U.S. patent application Ser. No. 13/531,065, filed on Jun. 22, 2012, which is a continuation of U.S. patent application Ser. No. 13/362,834, filed on Jan. 31, 2012, which is a continuation-in-part of U.S. patent application Ser. No. 13/231,434, filed on Sep. 13, 2011, and which also claims priority to U.S. Provisional Patent Application No. 61/580,949, filed on Dec. 28, 2011, and U.S. Provisional Patent Application No. 61/584,896, filed on Jan. 10, 2012, all of which are incorporated herein by reference in their entireties.

BACKGROUND

1. Field

The present application relates to headwear. More specifically, the present application is directed to a form-fitting protective headwear and a method of manufacturing the form-fitting protective headwear.

2. Brief Discussion of Related Art

Protective headwear can include hardhats, bumphats, helmets, headgear and other types of protective headwear, which provide a protective function (e.g., various levels of protection) against head injuries resulting from various impacts to the head associated with accidents and/or intentional acts of others. Protective headwear can be used for various activities ranging from military/security applications, to industrial applications, to sports activities, through to leisure activities. The different applications and activities can require different levels of protection and accordingly different headwear.

In many circumstances, head injuries can be prevented by using protective headwear. While job-related, sports-related, security-related as well as leisure-related head injuries can be very serious and even life threatening, some people (e.g., especially young people) may prefer not to wear headwear for various reasons, including aesthetics (e.g., user's look and feel), comfort (e.g., user feels uncomfortable wearing headwear), application/activity-specific fit (e.g., headwear for use in one application/activity does not accord well with use for another application/activity), and expense (e.g., headwear for different activities is too expensive). Other reasons may exist, such as experience level (e.g., user feels too experienced to wear headwear).

The foregoing and other reasons or factors can cause some people to go without protective headwear and increase the potential for serious head injuries. Accordingly, protective headwear should aim to not only to provide a protective function but should also aim to provide an inexpensive, yet aesthetic, comfortable and secure fit such that users would desire to wear the protective headwear. While providing the protective function, existing protective headwear frequently misses the mark and does not provide an aesthetic, comfortable and application-specific fit that is inexpensive, causing people to go without protective headwear and increasing the potential for serious head injuries.

Fit and positioning of headwear are essential to effectiveness at reducing head injury. In this regard, stretchable headwear (e.g., ski hats) offers the form-factor and the convenience of a precise fit and positioning for various head sizes. Stretchable headwear can be made of a various fabrics, including manmade/synthetic materials, natural materials, or blended combinations thereof. Accordingly, stretchable headwear can provide an inexpensive form-factor and esthetic quality, which can result in increased desirability. Desirability cannot be underestimated in people's desire or lack thereof for wearing protective headwear.

However, the method of placing protective materials (protective function) into stretchable headwear while maintaining its aesthetic quality have been problematic. On the one hand, hard layered plastics provide great protection but are too bulky and thus ruin the aesthetics, decreasing desirability and increasing the potential for serious head injuries. On the other hand, simple padding provides great esthetics but does not provide sufficient protection, decreasing the protective function and increasing the potential for serious head injuries. Furthermore, the manufacture of the stretchable headwear that incorporates sufficient protective function has met with challenges.

It is therefore desirable to provide a combination of sufficient protective function and aesthetics such that people will more readily wear protective headwear during their engagement in different activities and reduce the potential for serious injuries.

SUMMARY

In accordance with an embodiment, a protective headwear is disclosed. The protective headwear includes a body, a pocket band, a cuff and a plurality of protective inserts.

The body has an opening and a crown, and is configured to fit a head of a person.

The pocket band extends about the opening to an interior of the body and partially toward the crown. Moreover, the pocket band is free floating with respect to the body and configured to fit the head of the person. The pocket band also includes a plurality of pockets disposed about a base stitching that secures the pocket band to the body.

The cuff extends about the body and away from the crown. Moreover, the cuff incorporates a cuff element. The cuff element can be made of foam rubber, or other similar material.

The plurality of protective inserts configured to be received into the plurality of pockets to provide a protective function to the head of the person. Moreover, the protective inserts are disposed adjacently to one another about the pocket band and extend from the base stitching of the pocket band to the crown of the body.

These and other purposes, goals and advantages of the present application will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings in which:

FIG. 13 illustrates a cross-section of the example protective headwear of FIG. 11;

FIG. 14 illustrates a cross-section of the example protective headwear of FIG. 13 with the protective insert disposed in the pocket;

DETAILED DESCRIPTION

A form-fitting protective headwear and a method of manufacturing the form-fitting protective headwear are disclosed herein. In the following description, for the purposes of explanation, numerous specific details are set forth in order to provide a thorough understanding of example embodiments. It will be evident, however, to one skilled in the art, that an example embodiment may be practiced without all of the disclosed specific details.

Figure 1:
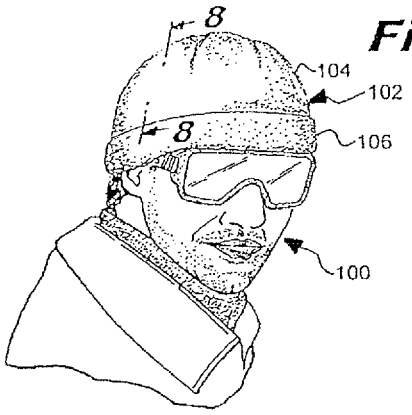
FIG. 1 illustrates a person wearing an example protective headwear in accordance with a first embodiment.

FIG. 1 illustrates a person 100 wearing an example protective headwear 102 in accordance with a first embodiment. The protective headwear 102 is configured to provide a combination of a significant protective function in an aesthetic form-factor, which improves desirability for wearing the protective headwear 102. More superficially, the protective headwear 102 provides the appearance of an aesthetic stretchable hat, while at the same time providing a significant protective function, which encourages the use of the protective headwear 102 and reduces the potential for head injuries.

The protective headwear 102 can be made from manmade/synthetic materials, natural materials, and/or blended combinations thereof. For example, wool, cotton, acrylic, nylon, other natural or synthetic materials, and combinations thereof can be used.

The protective headwear 102 is shown to include a body 104 and a cuff 106. The cuff 106 can be (but does not have to be) formed by cuffing or rolling an end portion of the body 102 over itself. The protective headwear 102 can be worn un-cuffed to cover the person's ears, or cuffed to partially cover the ears or completely above the ears. In some embodiments, a separate insertable cuff element (e.g., made of foam rubber, or other similar material) that is pliable and lightweight can be incorporated inside of and along the circumference of the cuff 106, as will be described in greater detail hereinbelow. In other embodiments, the protective headwear 102 can also be cuff-less (e.g., the cuff 106 can be omitted) and/or a visor can be stitched or secured to the body 104. As will be described in greater detail herein, the body 104 is configured to fit precisely and aesthetically over a person's head and to provide a protective function against head injury resulting from activities in which the person 100 engages.

The activities for which the protective headwear 102 will find implementation can include, for example, rollerblading, biking, hiking, skateboarding, touch football, soccer, field hockey, girls lacrosse, rock climbing, skiing, snowboarding, and ice-skating, as well as other sports and activities. In addition, other activities for which the protective headwear 102 will find implementation can include, for example, police, security, military and industrial applications. The foregoing list of activities is not exhaustive, and people engaged in other activities that are not enumerated can benefit from the protective function in an aesthetic form-factor provided by the protective headwear 102.

Figure 2:
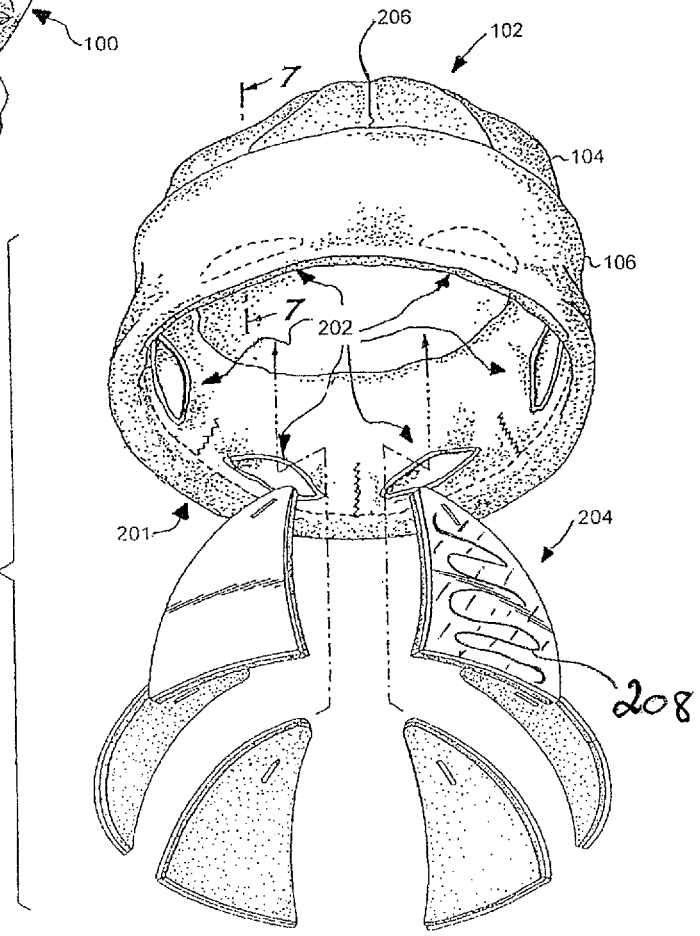
FIG. 2 illustrates the construction of the example protective headwear of FIG. 1.

FIG. 2 illustrates the construction of the example protective headwear 102 of FIG. 1. The protective headwear 102 includes a pocket band 201 and a plurality of protective inserts 204.

The pocket band 201 is disposed about at least a portion of the interior of the protective headwear 102 and is configured to receive and retain the protective inserts 204 in a predetermined configuration that provides a protective function to the person's head when the person 100 wears the protective headwear 102.

The pocket band 201 extends from the base stitching (FIG. 3, element 310) of the protective headwear 102 towards the apex or crown 206 of the protective headwear 102 such that the protective function can be provided to the head of the person 100. The protective headwear 102, and more particularly the pocket band 201 coupled with protective inserts 204, is configured to at least partially or fully cover the frontal, parietal, temporal and occipital part of the person's head.

The pocket band 201 includes a plurality of pockets 202, each of which is configured (e.g., sized and dimensioned) to receive and retain a respective protective insert 204, such that the plurality of protective inserts 204 can be disposed in the predetermined configuration in the pocket band 201 of the protective headwear 102. In some embodiments, six (6) pockets 202 are provided in the pocket band 201. In other embodiments, there can be four (4) to twelve (12) pockets 202. Fewer or greater number of pockets 202 can be provided in alternate embodiments.

The pockets 202 are disposed adjacently about the pocket band 201 such that the protective inserts 204 can be adjacently disposed (e.g., one next to the other), providing an almost continuous protective function about the protective headwear 102. The pockets 202 will be described in greater detail below with reference to FIG. 3. In some embodiments, the pockets 202 can be equidistantly disposed about the pocket band 201. In other embodiments, the pockets 202 can be disposed at different locations about the pocket band 201 based on the size and dimension of the respective protective inserts to be received into the pockets 202, as will be described below.

The protective inserts 204 are configured to be disposed adjacently to one another in the respective pockets 202 of the pocket band 201, providing an almost continuous protective function about the protective headwear 102. The protective inserts 204 are independently situated or disposed in the respective pockets 202 of the pocket band 201 and can conform to the contours of the person's head as the protective headwear 102 stretches about the person's head.

In various embodiments, the protective inserts 204 are approximately triangular in shape and yet are curvilinear, such that they conform to the contours of the person's head, approximating or joining at the crown of the person's head to provide an almost continuous protective function at the apex or crown 206 of the protective headwear 102.

In some embodiments, six (6) protective inserts 204 can be provided. In other embodiments, there can be four (4) to twelve (12) protective inserts 204. Fewer or greater number of protective inserts 204 can be provided in alternate embodiments. The protective inserts 204 will be described in greater detail with reference to FIGS. 4-6.

The protective inserts 204 can be similarly or differently sized and/or dimensioned (e.g., same or different triangular slices) such that the combination of the protective inserts 204 conform to the contours of the person's head, approximating or joining at the crown of the person's head to provide an almost continuous protective function at the apex or crown 206 of the protective headwear 102. For example, the protective inserts 204 in the front and/or the back of the protective headwear 102 can be wider triangular slices than the remaining slices therebetween. Other arrangements are possible of course. The pockets 202 can be adjusted based on the dimensions of the respective protective inserts 204.

Moreover, at least one protective insert 204 can include an adhesive layer 208 (e.g., double-sided adhesive tape or other material) disposed atop at least a portion of the protective insert 204 to enable the insert 204 to be removeably secured in the pocket band 201. In addition to or instead of adhesive layer 208, another adhesive layer can also be disposed on the back of the protective insert 204. In some embodiments, the protective inserts 204 with adhesive layers 208 can also be removeably secured inside headwear that may not be provided with the pocket band 201. A variety of adhesive layers 208 can be used to enable the protective inserts 204 to be removeably secured in the pocket band 201 of headwear 102 or on the interior of other headwear that may not be provided with the pocket band 201.

Figure 3:
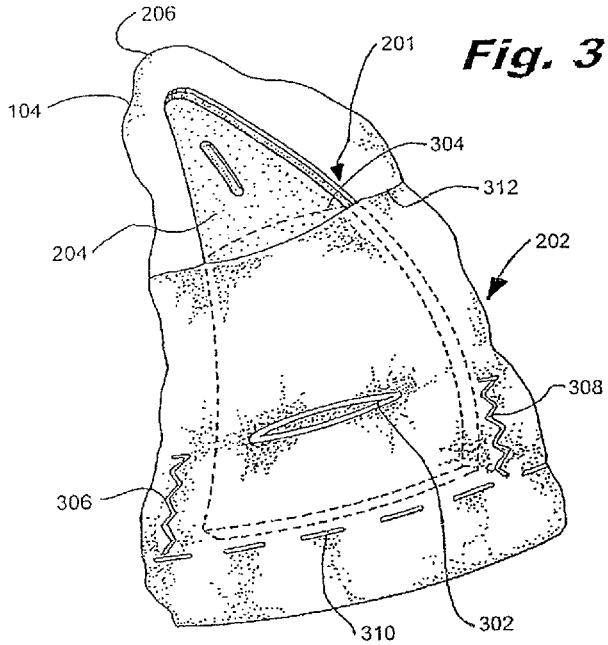
FIG. 3 illustrates the construction of an example pocket in the pocket band of the protective headwear of FIG. 2.

FIG. 3 illustrates the construction of an example pocket 202 in the pocket band 201 of FIG. 2. It should be noted that a plurality of pockets 202 can be formed in the pocket band 201 as illustrated in FIG. 2. For example, four (4) to twelve (12) pockets 202 can be formed in the pocket band 201. The pocket 202 includes at least one opening 302, 304 and is defined by side stitchings 306, 308 and base stitching 310.

The at least one opening 302, 304 is configured to receive the protective insert 204 into the pocket 202. In some embodiments, two (2) openings are provided in which a first opening 302 is disposed at a first distance above the base stitching 310 and a second opening 304 is disposed at a second distance above the base stitching 310. The first and second distances can be varied. For example, the second opening 304 can be disposed at the top-most extent 312 of the pocket band 201 (e.g., crease of the pocket band 201).

The second opening 304 can be offset from the top-most extent 312 of the pocket band 201, to either the front or the back of the pocket band 201. For example, the second opening 304 can be disposed in the back of the pocket band 201 between the pocket band 201 and the inside of the body 104. As another example, the second opening 304 can also be disposed in the front of the pocket band 201, similarly to the first opening 302.

Other alternatives are possible in which one or more of the openings 302, 304 are disposed in the back of the pocket band 201 between the pocket band 201 and the inside of the body 104. Such construction can allow both easy insertion of the protective insert 204, while hiding the potentially unsightly openings 302, 304 to the interior of the protective headwear 102.

Moreover, the openings 302, 304 are approximately centered in relation to the side stitchings 306, 308. The openings 302, 304 are stretchable in order to receive the protective insert 204 into the pocket 202. The openings 302, 304 can be formed to be more stretchable than the body 104 and the cuff 106 to facilitate insertion of the protective insert 204 into the pocket 202. The first opening 302 and second opening 304 can have approximately the same dimension. Alternatively, the second opening 304 can be smaller than the first opening 302, such that the protective insert 204 is initially received through the larger opening 302 and extends toward the apex or crown of the protective headwear 102 through the smaller opening 304 at the top-extent 312 of the pocket band 201.

In other embodiments, only one (1) opening is provided in the pocket 202 to receive the protective insert 204 into the pocket 202. More specifically, only the second opening 304 can be provided at the top-most extent 312 of the pocket band 201 (e.g., crease of the pocket band 201) or offset from the top-most extent 312 in the various alternatives as already described above.

The side stitchings 306, 308 of each pocket 202 extend approximately from the base stitching 310 and partially along the height of the pocket band 201 towards the apex or crown 206 of the protective headwear 102. In some embodiments, the side stitchings 306, 308 can extend to approximately the first opening 302 in the pocket 202. In other embodiments, the side stitchings 306, 308 can extend to the second opening 304, and further can extend partially or fully to the top-most extent 312 of the pocket band 201.

The side stitchings 306, 308 are further approximately angled towards one another and towards the apex or crown 206 of the protective headwear 102. More specifically, the stitchings 306, 308 can be angled to approximate and accommodate the angulation of each protective insert 204, such that the plural protective inserts 204 can be retained in a predetermined configuration with respect to one another in the respective pockets 202 and can provide an almost continuous protective function to the person's head when the person 100 wears the protective headwear 102.

The side stitchings 306, 308 can be z-stitch patterns to provide stretchability about a person's head. Straight stitching patterns (e.g., using elastic thread) can also be used for the side stitchings 306, 308. Other stitch patterns can be used for various advantages.

The base stitching 310 extends along the circumference of the pocket band 201 and is configured to provide a base or seat for each of the protective inserts 204, which approximates and accommodates the base of each protective insert 204, such that the plural protective inserts 204 can be retained in a predetermined configuration with respect to one another in the respective pockets 202 and can provide an almost continuous protective function to the person's head when the person 100 wears the protective headwear 102.

Figure 4:
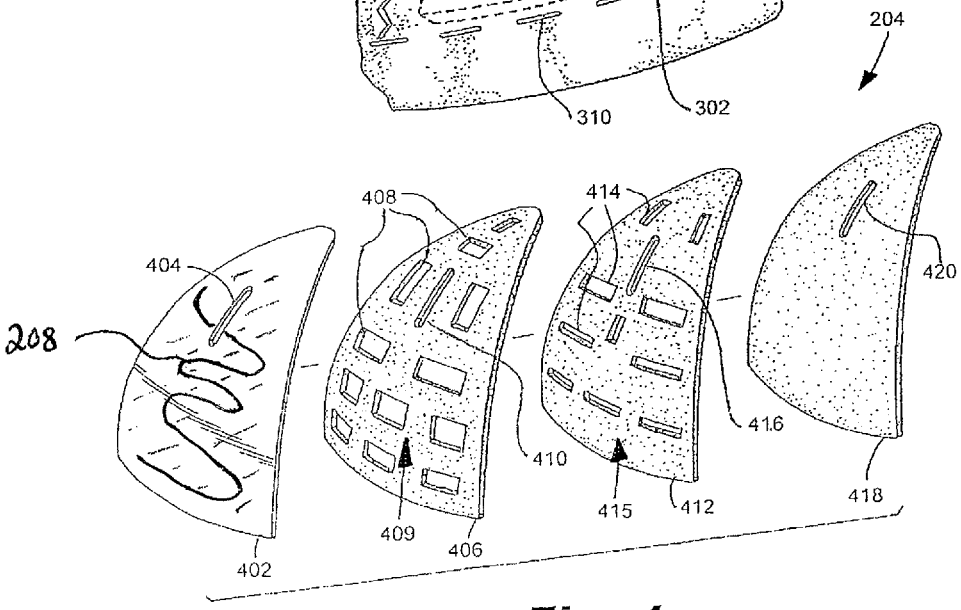
FIG. 4 illustrates the construction of an example protective insert in accordance with a first embodiment for insertion into the pocket band of FIGS. 2 and 12.

FIG. 4 illustrates the construction of an example protective insert 204 of FIG. 2 in accordance with a first embodiment. In the first embodiment, the example protective insert 204 includes a stack of four (4) layers 402, 406, 412, 418. The layers 402, 406, 412, 418 of the protective insert 204 are configured to provide a protective function to the person 100 when wearing the protective headwear 102.

The outermost layer 402 can be a durable and rigid plastic configured to provide impact-resistance from impacts which can cause serious trauma to the head of the person 100. For example, the layer 402 can be a thermoplastic, such as a polycarbonate or polymethyl methacrylate (PMMA), or another plastic that is sufficiently rigid yet can deform without cracking or breaking from an impact associated with an accident and/or intentional act of another person. Other durable and rigid plastics and/or combinations of various materials can be used to provide impact-resistance from impacts which can cause serious trauma to the head of the person 100.

In some embodiments, the outermost layer 402 is a polycarbonate having a thickness of approximately 0.09 inches to provide impact-resistance from general accidents, such as during industrial, sports or leisure activities. In other embodiments, the outermost layer 402 is a polycarbonate having a thickness of approximately 0.27 inches to provide impact-resistance (e.g., bulletproof resistance), such as during military, security and/or industrial activates. For example, the outermost layer 402 can have a thickness and be made of material(s) similar to bullet-proof glass. Other thicknesses can be provided based on the activity for which impact-resistance is desired.

The outermost layer 402 can include an opening or slit 404. In such cases, the other layers 406, 412 and 418 also can include openings or slits 410, 416 and 420, respectively. The openings 404, 410, 416 and 420 can approximate one another to provide a ventilation slit through the protective insert 204. One or more additional ventilation slits can be provided though the protective insert 204. The positioning and size of the ventilation slit can be changed.

The middle layers 406, 412 can be a pliable rubber (e.g., neoprene) configured to provide cushioning, as well as to mitigate and disperse (or distribute) the impact from the outermost layer 402 about the protective insert 204. Other pliable rubbers, materials and/or combinations or materials can be used. For example, one or more of the middle layers 406, 412 can be elastomers. The middle layers 406, 412 can further provide alternating arrangements 409, 415 of respective openings 408, 414. The openings 408, 414 can extend partially or fully through the middle layers 406, 412. In some embodiments, the openings 408, 414 can also be air pockets that are internal or embedded in the middle layers 406, 412 (e.g., not extending through surfaces of the middle layers 406, 412). In some other embodiments, the openings 408, 414 can be omitted.

When the middle layers 406, 412 are assembled into the protective insert 204, the respective openings 408, 414 are sealed to provide air pockets, which can absorb and disperse the impact from the outermost layer 402 about the protective insert 204. The middle layers 406, 412 can have adhesive surfaces such that layers 402, 406, 412, 418 can be easily sealed with respect to one another to provide the foregoing air pockets. In some embodiments, the outermost layer 402 and the middle layer 406 can be sealed using a process known as overmolding. In such embodiments, one or more of the layers 412, 418 can have adhesive surfaces for sealing. In various embodiments, the alternating arrangements 409, 415 about the layers 406, 412 can be amended or changed. The shapes and dimensions of the respective openings 408, 414 can be different or the same in the various alternating arrangements 409, 415.

In some embodiments, the middle layer 406 can have a thickness 0.25 inches, while the middle layer 412 can have a thickness of 0.125 inches. In these embodiments, a portion of the protective insert 204 covered by air pockets from the openings 408 in the alternating arrangement 409 can be larger than a portion of the protective insert 204 covered by air pockets from the openings 414 in the alternating arrangement 415. Alternative thicknesses, arrangements and/or coverage distribution amongst the middle layers 406, 412 are of course possible. For example, the order of the middle layers 406, 412 can be reversed in relation to the outermost layer 402 and the innermost layer 418.

It is important to note that the alternating arrangements 409, 415 enable air pockets formed from various openings 404, 414 to cover a substantial portion of the protective insert 204 in order to provide improved absorption and dispersal (or distribution) of the impact from the outermost layer 402 about the protective insert 204. In some embodiments, the coverage of the protective insert 204 by the air pockets formed from various openings 404, 414 can be continuous. More specifically, the openings 404 of the arrangement 409 are approximately non-overlapping and approximately contiguous with the openings 414 of the alternating arrangement 415, such that a substantial portion of the protective insert 204 can be provided (or covered) with air pockets, enhancing the absorption and distribution (e.g. deflection) of the impact about the at least one protective insert 204, mitigating or eliminating the possibility of serious injury to the head.

The innermost layer 418 is configured to provide additional cushioning and to enclose or seal middle layers 406, 412 between the outermost layer 402 and the innermost layer 418. The innermost layer 418 can be a pliable rubber (e.g., neoprene) and can have a thickness of 0.0625 inch. Other pliable rubbers or other materials can be used. For example, the innermost layer 418 can be an elastomer. In some embodiments, the innermost layer 418 can be omitted.

In various embodiments, the innermost layer 418 can cover the middle layers 406, 412 (particularly middle layer 412) partially or fully. The innermost layer 418 can cover a certain portion of the middle layer 412, such as a bottom, middle, top or other portion. For example, the innermost layer 418 can cover a bottom portion (e.g., 25% to 50%, or a greater or smaller range) of the middle layer 412. As another example, innermost layer 418 can cover a portion of the middle layer 412 that includes one or more of the openings 414 (e.g., partial or full arrangement 415 of openings 414), such as disposed about the bottom, middle, top or other portion of the middle layer 412.

Figure 5:
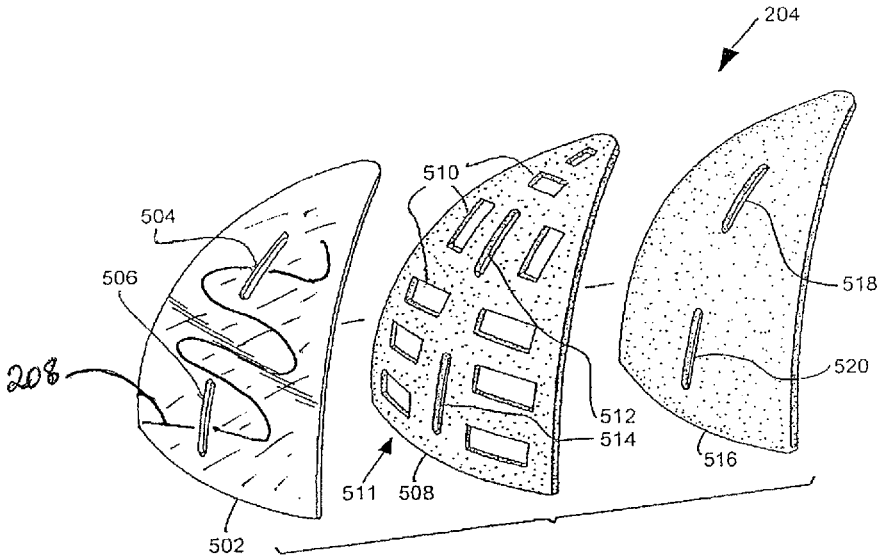
FIG. 5 illustrates the construction of an example protective insert in accordance with a second embodiment for insertion into the pocket band of FIGS. 2 and 12.

FIG. 5 illustrates the construction of an example protective insert 204 of FIG. 2 in accordance with a second embodiment. In the second embodiment, the example protective insert 204 includes a stack of three (3) layers 502, 508, 516. The layers 502, 508, 516 of the protective insert 204 are configured to provide a protective function to the person 100 when wearing the protective headwear 102.

The outermost layer 502 can be a durable and rigid plastic configured to provide impact-resistance from impacts which can cause serious trauma to the head of the person 100. For example, the outermost layer 502 can be a thermoplastic, such as a polycarbonate or another plastic that is sufficiently rigid yet can deform without cracking or breaking from an impact associated with an accident and/or intentional act of another person. Other durable and rigid plastics or combinations of materials can be used to provide impact-resistance from impacts which can cause serious trauma to the head of the person 100.

In some embodiments, the outermost layer 502 is a polycarbonate having a thickness of approximately 0.09 inches to provide impact-resistance from general accidents, such as during sports, industrial or leisure activities. In other embodiments, the outermost layer 502 is a polycarbonate having a thickness of approximately 0.27 inches to provide impact-resistance (e.g., bulletproof resistance), such as during military, security and/or industrial activates. For example, the outermost layer 402 can have a thickness and be made of material(s) similar to bullet-proof glass. Other thicknesses can be provided based on the activity for which impact-resistance is desired.

The outermost layer 502 can include openings or slits 504, 506. In such cases, the other layers 508, 516 also can include corresponding openings or slits 512, 514, 518, 520, respectively. The openings slits 504, 506, 512, 514, 518, 520 can provide ventilation slits through the protective insert 204. The number, positioning and size of the ventilation slits can be changed.

The middle layer 508 can be a pliable rubber (e.g., neoprene) configured to provide cushioning, as well as to mitigate and disperse the impact from the outermost layer 502 about the protective insert 204. Other pliable rubbers or other materials can be used. For example, the middle layers 508 can be an elastomer. The middle layer 508 can provide an arrangement 511 of openings 510. The openings 510 can extend partially or fully through the middle layer 508. In some embodiments, the openings 510 can also be air pockets that are internal or embedded in the middle layer 508 (e.g., not extending through surfaces of the middle layer 508). In some other embodiments, the openings 510 can be omitted.

The middle layer 508 can further have adhesive surfaces that when the middle layer 508 is assembled into the protective insert 204, the openings 510 can be easily sealed to provide air pockets, which can absorb and disperse the impact from the outermost layer 502 about the protective insert 204. In some embodiments, the outermost layer 502 and the middle layer 508 can be sealed using a process known as overmolding. In such embodiments, the other layer 516 can have an adhesive surface for sealing. In various embodiments, the arrangement 511 can be changed.

In some embodiments, layer 508 can have a thickness between about 0.0625 inches and about 0.1875 inches. Alternating thicknesses of the middle layer 508 are of course possible. It is important to note that the arrangement 511 enables air pockets formed from openings 510 to cover a substantial portion of the protective insert 204 in order to provide absorption and dispersal the impact from the outermost layer 502 about the protective insert 204.

The innermost layer 516 is configured to provide additional cushioning and to enclose or seal the middle layer 508 between the outermost layer 502 and the innermost layer 516. The innermost layer 516 can be a pliable rubber (e.g., neoprene) and can have a thickness of 0.0625 inch. Other pliable rubbers or other materials can be used. For example, the innermost layer 516 can be an elastomer. In some embodiments, the innermost layer 516 can be omitted.

In various embodiments, the innermost layer 516 can cover the middle layer 508 partially or fully. The innermost layer 516 can cover a certain portion of the middle layer 508, such as a bottom, middle, top or other portion. For example, the innermost layer 516 can cover a bottom portion (e.g., 25% to 50%, or a greater or smaller range) of the middle layer 508. As another example, innermost layer 516 can cover a portion of the middle layer 508 that includes one or more of the openings 510 (e.g., partial or full arrangement 511 of openings 510), such as disposed about the bottom, middle, top or other portion of the middle layer 508.

Figure 6:
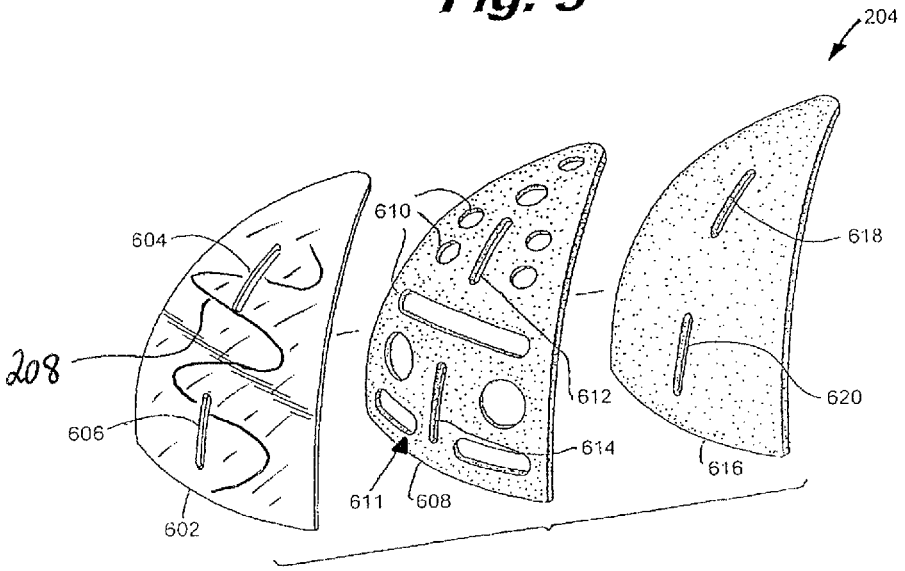
FIG. 6 illustrates the construction of an example protective insert in accordance with a third embodiment for insertion into the pocket band of FIGS. 2 and 12.

FIG. 6 illustrates the construction of an example protective insert 204 of FIG. 2 in accordance with a third embodiment. In the third embodiment, the example protective insert 204 also includes a stack of three (3) layers 602, 608, 616. The layers 602, 608, 616 of the protective insert 204 are configured to provide a protective function to the person 100 when wearing the protective headwear 102.

The outermost layer 602 can be a durable and rigid plastic configured to provide impact-resistance from impacts which can cause serious trauma to the head of the person 100. For example, the outermost layer 602 can be a thermoplastic, such as a polycarbonate or another plastic that is sufficiently rigid yet can deform without cracking or breaking from an impact associated with an accident and/or intentional act of another person. Other durable and rigid plastics or combinations of materials can be used to provide impact-resistance from impacts which can cause serious trauma to the head of the person 100.

In some embodiments, the outermost layer 602 is a polycarbonate having a thickness of approximately 0.09 inches to provide impact-resistance from general accidents, such as during sports, industrial or leisure activities. In other embodiments, the outermost layer 602 is a polycarbonate having a thickness of approximately 0.27 inches to provide impact-resistance (e.g., bulletproof resistance), such as during military, security and/or industrial activates. For example, the outermost layer 402 can have a thickness and be made of material(s) similar to bullet-proof glass. Other thicknesses can be provided based on the activity for which impact-resistance is desired.

The outermost layer 602 can include openings or slits 604, 606. In such cases, the other layers 608, 616 also can include corresponding openings or slits 612, 614, 618, 620, respectively. The openings 604, 606, 612, 614, 618, 620 can provide ventilation slits through the protective insert 204. The number, positioning and size of the ventilation slits can be changed.

The middle layer 608 can be a pliable rubber (e.g., neoprene) configured to provide cushioning, as well as to mitigate and disperse the impact from the outermost layer 602 about the protective insert 204. Other pliable rubbers or other materials can be used. For example, the middle layers 608 can be an elastomer. More specifically, the middle layer 608 can provide an arrangement 611 of openings 610. The openings 610 can extend partially or fully through the middle layer 608. In some embodiments, the openings 610 can also be air pockets that are internal or embedded in the middle layer 608 (e.g., not extending through surfaces of the middle layer 608). In some other embodiments, the openings 610 can be omitted The middle layer 608 can have adhesive surfaces such that the middle layer 608 is assembled into the protective insert 204, the openings 610 can be easily sealed to provide air pockets, which can absorb and disperse the impact from the outermost layer 602 about the protective insert 204. In some embodiments, the outermost layer 602 and the middle layer 608 can be sealed using a process known as overmolding. In such embodiments, the other layer 616 can have an adhesive surface for sealing. In various embodiments, the arrangement 611 can be changed. The pockets in the third embodiment have a more circular shape or oblong shape (without sharp corners), which can provide for a more uniform distribution or dispersal of the impact from the outermost layer 602 about the protective insert 204.

In some embodiments, layer 608 can have a thickness between about 0.0625 inches and about 0.1875 inches. Alternating thicknesses of the middle layer 608 are of course possible. It is important to note that the arrangement 611 enables air pockets formed from openings 610 to cover a substantial portion of the protective insert 204 in order to provide absorption and dispersal the impact from the outermost layer 602 about the protective insert 204.

The innermost layer 616 is configured to provide additional cushioning and to enclose or seal the middle layer 608 between the outermost layer 602 and the innermost layer 616. The innermost layer 616 can be a pliable rubber (e.g., neoprene) and can have a thickness of 0.0625 inch. Other pliable rubbers or other materials can be used. For example, the middle layers 616 can be an elastomer. In some embodiments, the innermost layer 616 can be omitted.

In various embodiments, the innermost layer 616 can cover the middle layer 608 partially or fully. The innermost layer 616 can cover a certain portion of the middle layer 608, such as a bottom, middle, top or other portion. For example, the innermost layer 616 can cover a bottom portion (e.g., 25% to 50%, or a greater or smaller range) of the middle layer 608. As another example, innermost layer 616 can cover a portion of the middle layer 608 that includes one or more of the openings 610 (e.g., partial or full arrangement 611 of openings 610), such as disposed about the bottom, middle, top or other portion of the middle layer 608.

Figure 7:
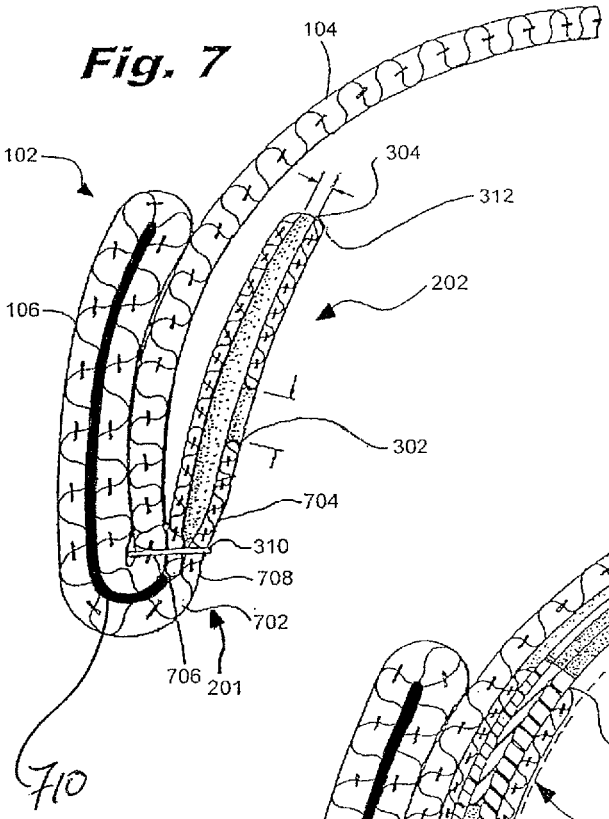
FIG. 7 illustrates a cross-section of the example protective headwear in accordance with the first embodiment of FIG. 1.

FIG. 7 illustrates a cross-section of the example protective headwear 102 in accordance with the first embodiment of FIG. 1.

The protective headwear 102—including the body 104, cuff 106 and pocket band 201—can be weaved in a continuous weaving process on a loom or another automated weaving machine. The body 104 and cuff 106 of the headwear 102 can be weaved from a thread and/or weave of a first thickness 702.

During the continuous weaving process, the thread and/or weave of the first thickness 702 can be automatically continued with a thread and/or a weave of a second thickness 704 at approximately location 708 to form the pocket band 201, such that the protective headwear 102 is of a continuous and/or monolithic construction. For example, the first thickness 702 can be approximately 0.25 inches, while the second thickness 702 can be approximately 0.03 inches. Other first and second thicknesses 702, 704 can of course be used. It is noted, however, that the aim is to provide a pocket band 201 having minimized thickness in relation to the thickness of the body 104, while also providing stretchability to receive protective inserts 204 into the pocket band 201 and durability/strength to retain the protective inserts 204 in the pocket band 201.

At the top-most extent 312 of the pocket band 201, the pocket band 201 is folded (e.g., providing a crease in the pocket band 201). More specifically, an end 706 of the pocket band 201 is tucked or folded to the interior of the protective headwear 102, and more particularly to the interior of the body 104, and the base stitching 310 is applied at approximately location 708 to capture or secure the end 706, completing the pocket band 201 and delineating the pocket band 201 from the body 104 and the cuff 106. In some embodiments, a separate insertable cuff element 710 (e.g., made of foam rubber, or other similar material) that is pliable and lightweight can be incorporated inside of and along the circumference of the cuff 106. The thickness, height and diameter of the cuff element 710 can vary based on dimensions of the cuff 106 of the headwear 102.

As illustrated, the pocket band 201 is free floating with respect to the body 104 of the protective headwear 102, such that the pocket band 201 can provide application-specific or precise fit and positioning of plural protective inserts 204 for various head sizes to effectively reduce and/or eliminate head injuries. As described previously herein, one or both openings 302, 304 can be provided to allow insertion of the protective insert 204 into the pocket 202.

As further illustrated, the second thickness 704 can be reduced from the first thickness 702 (e.g., approximately by half or smaller from the first thickness 702) such that sufficient space can be provided in the pocket 202 of the pocket band 201 to receive a protective insert 204, providing an aesthetic, comfortable and inexpensive form-factor that can result in increased desirability and usability of protective headwear 102 to mitigate and/or eliminate head injuries.

Figure 8:
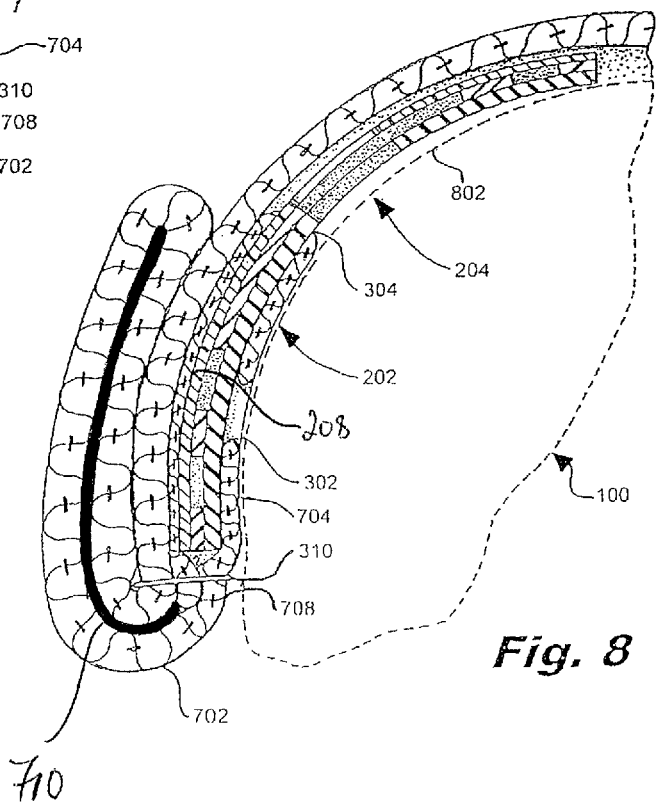
FIG. 8 illustrates a cross-section of the example protective headwear of FIG. 7 with the protective insert disposed in the pocket.

FIG. 8 illustrates a cross-section of the example protective headwear 102 of FIG. 7 with the protective insert 204 disposed in the pocket 202.

As illustrated, the base stitching 310 further provides a base to retain the protective insert 204 in the pocket 202. As described previously herein, the protective insert 204 is inserted into the pocket 202 of the pocket band 201 through either the opening 302 and followed by the opening 304, if two (2) openings are provided, or through the opening 304 if only one (1) opening is provided.

The openings 302, 304 are stretchable to receive the protective insert 204 into the pocket 202 (e.g., based on the stretchable material from which the protective headwear 102 is made). The adhesive layer 208 illustrated in FIG. 2, if provided atop a portion of the protective insert 204 that is received in the pocket 202, can enable the protective insert 204 to be removeably secured in relation to the pocket band 201. Accordingly, once the protective insert 204 is received into the pocket 202, opening 304 can contour about the triangular shape of the protective insert 204 to retain or removeably secure the protective insert in the pocket 202.

As further illustrated, the pocket band 201 with the inserted protective insert 204 is free floating with respect to the body 104 of the protective headwear 102, such that the pocket band 201 can provide application-specific or precise fit and positioning of the plural protective inserts 204 for various head sizes (e.g., such as the head 802 of the person 100) to effectively reduce and/or eliminate head injuries.

Moreover, the second thickness 704 compared to thickness 702 provides space in the pocket 202 of the pocket band 201 for the protective insert 204, facilitating an aesthetic, comfortable and inexpensive form-factor that can result in increased desirability and usability of protective headwear 102 to mitigate and/or eliminate head injuries.

Figure 9:
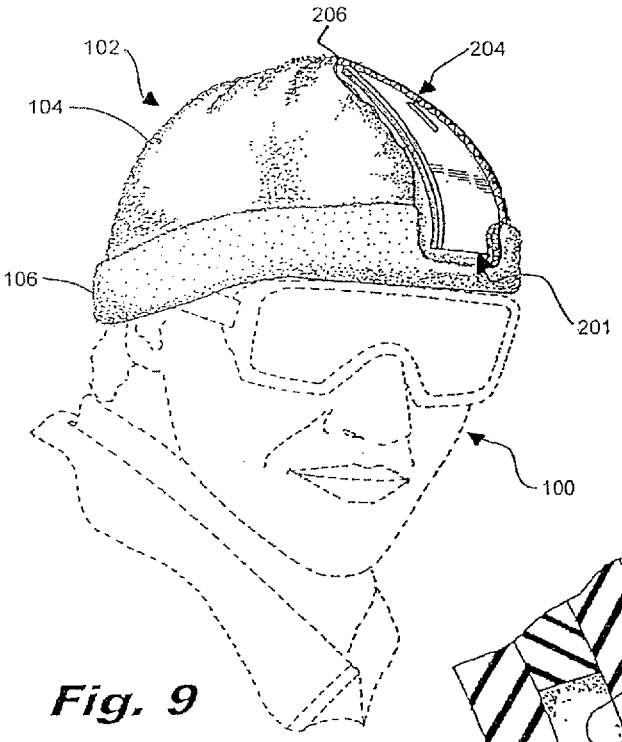
FIG. 9 illustrates a person wearing the protective headwear of FIG. 1 cutaway to reveal the protective insert in relation to the body and the cuff of the protective headwear.

FIG. 9 illustrates a person 100 wearing the protective headwear 102 of FIG. 1 cutaway to expose or reveal the protective insert 204 in relation to the body 104 and cuff 106.

Plural protective inserts 204 are secured by the pocket band 201—and more particularly, by the respective pockets 202 of the pocket band 201—around the head of the person 100 and conform or contour to the head of the person 100, providing a protective function to the frontal, parietal, temporal and occipital parts of the person's head.

The protective inserts 204 provide an almost continuous protective function amongst and between the protective inserts 204, about the circumference of the protective band 201 and through to the apex or crown 206 of the protective headwear 102.

Figure 10:
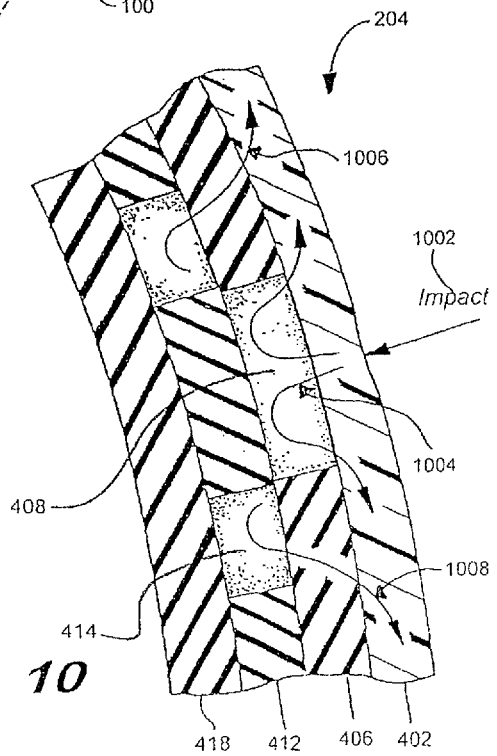
FIG. 10 illustrates a cross-section of the protective insert in accordance with the first embodiment of FIG. 4 showing an example protective function in response to an impact.

FIG. 10 illustrates a cross-section of the protective insert 204 in accordance with the first embodiment of FIG. 4 to show the example protective function.

As illustrated, an example impact 1002 is delivered to the protective insert 204 illustrated in the cutaway of FIG. 9. More specifically, the impact 1002 can be delivered by accident or willfully by another person to the outermost layer 402, which can deform but is configured not to crack or break. The force of the impact 1002 is absorbed and distributed or dispersed through the layers 402, 406, 412, 418 as follows.

The sealed air pockets 408, 414 in the respective middle layers 406, 412 distribute or disperse the impact 1002 about the protective insert 204 as illustrated by arrows 1004, 1006, 1008. More specifically, the force of the impact 1002 cannot fully continue through the air pockets 404, 414. When the air that is sealed (or trapped) in the air pockets 408, 414 is compressed by the impact 1002, the air pockets 408, 414 deflect or distribute a portion of the force of the impact 1002 to the surrounding layers 402, 406, 412, 418 that are contiguous to the air pockets 408, 414. The trapped air deforms the pliable middle and innermost layers 406, 412, 418. These layers 406, 412 absorb portions of the force of the impact 1002 to provide cushioning to the head of the person 100, while some portions of the force of the impact 1002 are also dispersed and spread over the outermost layer 402.

Figure 11:
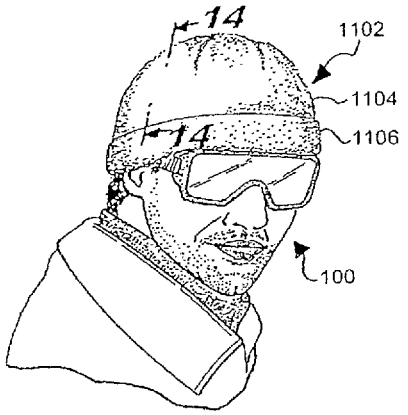
FIG. 11 illustrates a person wearing an example protective headwear in accordance with a second embodiment.

FIG. 11 illustrates a person 100 wearing an example protective headwear 1102 in accordance with a second embodiment. The protective headwear 1102 is configured to provide a combination of a significant protective function in an aesthetic form-factor, which improves desirability for wearing the protective headwear 1102. More superficially, the protective headwear 1102 provides the appearance of an aesthetic stretchable hat, while at the same time providing a significant protective function, which encourages the use of the protective headwear 1102 and reduces the potential for head injuries.

The protective headwear 1102 can be made from man-made/synthetic materials, natural materials, and/or blended combinations thereof. For example, wool, cotton, acrylic, nylon, other natural/synthetic materials, and combinations thereof can be used. The protective headwear 1102 is shown to include a body 1104 and a cuff 1106. The cuff 1106 can be (but does not have to be) formed by cuffing or rolling an end portion of the body 1102 over itself. In some embodiments, a separate insertable cuff element (e.g., made of foam rubber, or other similar material) that is pliable and lightweight can be incorporated inside of and along the circumference of the cuff 106, as will be described in greater detail hereinbelow. In other embodiments, the protective headwear 1102 can also be cuff-less (e.g., the cuff 1106 can be omitted) and/or a visor can be stitched or secured to the body 1104. The protective headwear 1102 can be worn un-cuffed to cover the person's ears, or cuffed to partially cover the ears or completely above the ears.

The body 1104 is configured to fit precisely and aesthetically over a person's head and to provide a protective function against head injury resulting from activities in which the person 100 engages. The activities for which the protective headwear will find implementation can include, for example, rollerblading, biking, hiking, skateboarding, touch football, soccer, field hockey, girls lacrosse, rock climbing, skiing, snowboarding, and ice-skating, as well as other sports and activities as described herein.

Figure 12:
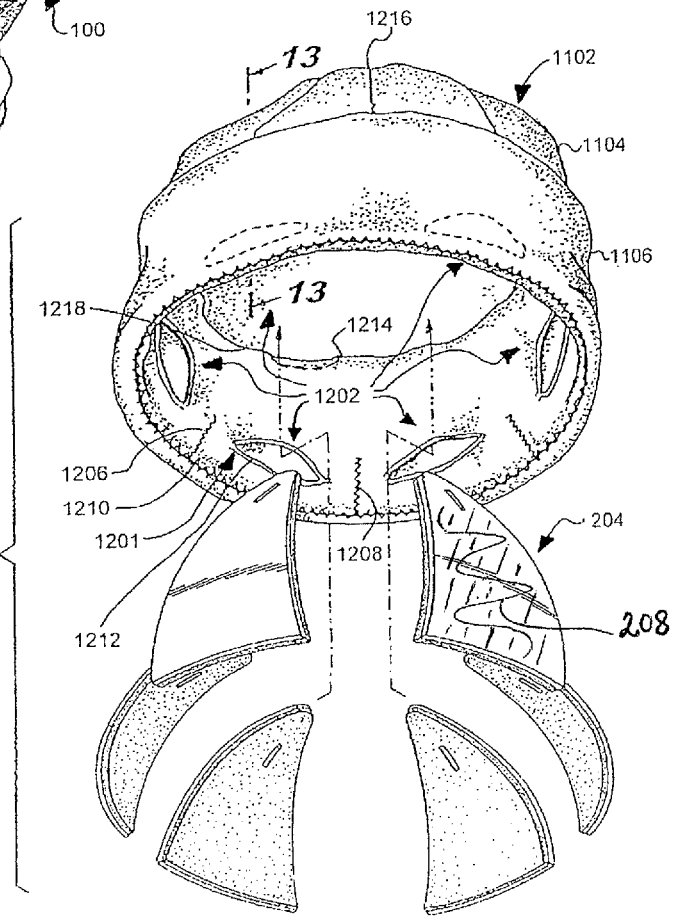
FIG. 12 illustrates the construction of the example protective headwear of FIG. 11.

FIG. 12 illustrates the construction of the example protective headwear 1102 of FIG. 11. The protective headwear 1102 includes a pocket band 1201 and a plurality of protective inserts 204. In this second embodiment, the pocket band 1201 can be provided (e.g., weaved) separately from the headwear 1102 and then attached (e.g., stitched) to the protective headwear 1102.

Moreover, in various other embodiments the pocket band 1201 can be manufactured or provided as a liner, for example, which can remain separate from the protective headwear 1102, such that the protective headwear 1102 can be completed when the protective headwear 1102 (or another cap, hat or the like) is worn over the combination of the liner (e.g., pocket band 1201) and the protective inserts 204.

Now with further reference to FIG. 12, the pocket band 1201 is disposed about at least a portion of the interior of the protective headwear 1102 and is configured to receive and retain the protective inserts 204 in a predetermined configuration that provides a protective function to the person's head when the person 100 wears the protective headwear 1102.

The pocket band 1201 extends from the base stitching 1210 of the protective headwear 1102 towards the apex or crown 1216 of the protective headwear 1102 such that the protective function can be provided to the head of the person 100. The protective headwear 1102, and more particularly the pocket band 1201 coupled with protective inserts 204, is configured to at least partially or fully cover the frontal, parietal, temporal and occipital part of the person's head.

The pocket band 1201 includes a plurality of pockets 1202, each of which is defined by the side stitchings 1206, 1208 and the base stitching 1210. Each of the pockets 1202 is configured (e.g., sized and dimensioned) to receive and retain a respective protective insert 204, such that the plurality of protective inserts 204 can be disposed in the predetermined configuration in the pocket band 1201 of the protective headwear 1102. In some embodiments, six (6) pockets 1202 are provided in the pocket band 1201. In other embodiments, there can be four (4) to twelve (12) pockets 1202. Fewer or greater number of pockets 1202 can be provided in alternate embodiments.

The plurality of pockets 1202 are disposed adjacently about the pocket band 1201 such that the protective inserts 204 can be adjacently disposed (e.g., one next to the other), providing an almost continuous protective function about the protective headwear 1102. In some embodiments, the pockets 1202 can be equidistantly disposed about the pocket band 1201. In other embodiments, the pockets 1202 can be disposed at different locations about the pocket band 1201 based on the size and dimension of the respective protective inserts to be received into the pockets 1202.

Each pocket 202 includes at least one opening 1212, 1214, which is configured to receive the protective insert 204 into the pocket 1202. In some embodiments, two (2) openings are provided in which a first opening 1212 is disposed at a first distance above the base stitching 1210 and a second opening 1214 is disposed at a second distance above the base stitching 1210. The first and second distances can be varied. For example, the second opening 1214 can be disposed at the top-most extent 1218 of the pocket band 1201 (e.g., crease of the pocket band 1201).

The second opening 1214 can be offset from the top-most extent 1218 of the pocket band 1201, to either the front or the back of the pocket band 1201. For example, the second opening 1214 can be disposed in back of the pocket band 1201 between the pocket band 1201 and the inside of the body 1104. As another example, the second opening 1214 can also be disposed in front of the pocket band 1201, similarly to the first opening 1212. Other alternatives are possible in which one or more of the openings 1212, 1214 are disposed in the back of the pocket band 1201 between the pocket band 1201 and the inside of the body 1104. Such construction can allow both easy insertion of the protective insert 1204, while hiding the potentially unsightly openings 1212, 1214 to the interior of the protective headwear 1102.

Moreover, the openings 1212, 1214 can be approximately centered in relation to the side stitching 1206, 1208. The openings 1212, 1214 are stretchable in order to receive the protective insert 204 into the pocket 1202. The openings 1212, 1214 can be formed to be more (or less) stretchable than the body 104. The first opening 1212 and second opening 1214 can have approximately the same dimension. Alternatively, the second opening 1214 can be smaller than the first opening 1214, such that the protective insert 204 is initially received through the larger opening 1212 and extends toward the apex or crown 1216 of the protective headwear 1102 through the smaller opening 1214 at the top-extent 1218 of the pocket band 1201. The first and second openings 1212, 1214 can also have the same or different levels of stretchability with respect to one another and with respect to the body 1104 and the cuff 1106.

In other embodiments, only one (1) opening is provided in the pocket 1202 to receive the protective insert 204 into the pocket 1202. More specifically, only the second opening 1214 can be provided at the top-most extent 1218 of the pocket band 1201 (e.g., crease of the pocket band 201) or offset from the top-most extent 1218 in the various alternatives as already described above.

The side stitchings 1206, 1208 of each pocket 1202 extend approximately from the base stitching 1210 and partially along the height of the pocket band 1201 towards the apex or crown 1216 of the protective headwear 1102. In some embodiments, the side stitchings 1206, 1208 can extend to approximately the first opening 1212 in the pocket 1202. In other embodiments, the side stitchings 1206, 1208 can extend to the second opening 1214, and further can extend partially or fully to the top-most extent 1218 of the pocket band 1201.

The side stitchings 1206, 1208 are further approximately angled towards one another and towards the apex or crown 1216 of the protective headwear 1102. More specifically, the stitchings 1206, 1208 can be angled to approximate and accommodate the angulation of each protective insert 204, such that the plural protective inserts 204 can be retained in a predetermined configuration with respect to one another in the respective pockets 1202 and can provide an almost continuous protective function to the person's head when the person 100 wears the protective headwear 1102.

The side stitchings 1206, 1208 can be z-stitch patterns to provide stretchability about a person's head. Straight stitching patterns (e.g., using elastic thread) can also be used for the side stitchings 1206, 1208. Other stitch patterns can be used for various advantages.

The base stitching 1210 can be a z-stitch pattern and extends along the circumference of the pocket band 1201. The base stitching 1210 is configured to provide a base or seat for each of the protective inserts 204, approximating and accommodating the base of each protective insert 204, such that the plural protective inserts 204 can be retained in a predetermined configuration with respect to one another in the respective pockets 1202 and can provide an almost continuous protective function to the person's head when the person 100 wears the protective headwear 1102.

The base stitching 1210 is further configured to secure the separately weaved or manufactured pocket band 1201 to the interior of the protective headwear 1102 as described in greater detail below. As described hereinabove, the pocket band 1201 can be manufactured or provided as a liner separate from the protective headwear 1102, such that the protective headwear 1102 can be completed when the protective headwear 1102 (or another cap, hat or the like) is worn over the combination of the liner (e.g., pocket band 1201) and protective inserts 204. In such cases, the base stitching 1210 can be applied to the pocket band 1201 to enclose and complete the pockets 1202 of the pocket band 1201.

The protective inserts 204 are configured to be disposed adjacently to one another in the respective pockets 1202 of the pocket band 1201, providing an almost continuous protective function about the protective headwear 1102. The protective inserts 204 are independently situated or disposed in the respective pockets 1202 of the pocket band 1201 and can conform to the contours of the person's head as the protective headwear 1102 stretches about the person's head.

The protective inserts 204 are described in greater detail with reference to FIGS. 4-6 hereinabove. In some embodiments, six (6) protective inserts 204 can be provided. In other embodiments, there can be four (4) to twelve (12) protective inserts 204. Fewer or greater number of protective inserts 204 can be provided in different embodiments based on the number of pockets 1202.

As described hereinabove, the protective inserts 204 can also include adhesive layers 208 to enable the protective inserts 208 to be removeably secured in the pocket band 1201 of headwear 1102 or on the interior of other headwear that may not be provided with the pocket band 1201.

FIG. 13 illustrates a cross-section of the example protective headwear 1102 in accordance with the second embodiment of FIG. 11.

The pocket band 1201 can be weaved in a first weaving process on a loom or another automated weaving machine, and can be weaved from a thread and/or weave of the first thickness 1302.

The body 1104 and cuff 1106 can be weaved in a second weaving process on a loom or another automated weaving machine, and the pocket band 1201 can then be attached to the body 1104 and cuff 1106. The protective headwear 1102 can be cuff-less and the pocket band 1201 can thus be attached to the body 1104. The first and second weaving processes can be contemporaneous, sequential or can be performed at various times. The body 1104 and cuff 1106 of the protective headwear 1102 can be weaved from a thread and/or weave of a second thickness 1304.

The second thickness 1304 can be reduced from the first thickness 1302 (e.g., approximately by half or smaller from the first thickness) such that sufficient space can be provided in the pocket 1202 of the pocket band 1201 to receive a protective insert 204, providing an aesthetic, comfortable and inexpensive form-factor that can result in increased desirability and usability of protective headwear 102 to mitigate and/or eliminate head injuries. The first and second thicknesses 1302, 1304 can be same as or different than the first and second thicknesses 702, 704, as described in relation to the first embodiment of the protective headwear 102 in FIG. 7.

After the second weaving process, the pocket band 1201 is attached or secured by ends 1306 to the protective headwear 1102 to form the pocket band 1201, such that the protective headwear 1102 can receive and retain plural protective inserts 204 in the pockets 1204 of the pocket band 1201.

At the top-most extent 1218 of the pocket band 1201, the pocket band 1201 is folded (e.g., providing a crease in the pocket band 1201). More specifically, the ends 1306 of the pocket band 1201 are secured to the protective headwear 1102 by the base stitching 1210, completing the pocket band 1201 and the cuff 1106 (if provided), as well as delineating the pocket band 1201 from the body 1104 and the cuff 1106 (if provided). In some embodiments, a separate insertable cuff element 1308 (e.g., made of foam rubber, or other similar material) that is pliable and lightweight can be incorporated inside of and along the circumference of the cuff 1106. The thickness, height and diameter of the cuff element 1308 can vary based on dimensions of the cuff 1106 of the headwear 1102.

As illustrated, the pocket band 1201 is free floating with respect to the body 1104 of the protective headwear 1102, such that the pocket band 1201 can provide application-specific or precise fit and positioning of plural protective inserts 204 for various head sizes to effectively reduce and/or eliminate head injuries. As described previously herein, one or both openings 1212, 1214 can be provided to allow insertion of the protective insert 204 into the pocket 1202.

As further illustrated, the second thickness 1304 can be reduced from the first thickness 1302 (e.g., approximately by half or smaller from the first thickness 1302) such that sufficient space can be provided in the pocket 1202 of the pocket band 1201 to receive a protective insert 204, providing an aesthetic, comfortable and inexpensive form-factor that can result in increased desirability and usability of protective headwear 1102 to mitigate and/or eliminate head injuries.

FIG. 14 illustrates a cross-section of the example protective headwear 1102 of FIG. 13 with the protective insert 204 disposed in the pocket 1202.

As illustrated, the base stitching 1210 further provides a base to retain the protective insert 204 in the pocket 1202. As described previously herein, the protective insert 204 is inserted into the pocket 1202 of the pocket band 1201 through either the opening 1212 and followed by the opening 1214, if two (2) openings are provided, or through the opening 1214 if only one (1) opening is provided.

The openings 1212, 1214 are stretchable to receive the protective insert 204 into the pocket 1202 (e.g., based on the stretchable material from which the protective headwear 1102 is made). The adhesive layer 208 illustrated in FIG. 12, if provided atop a portion of the protective insert 204 that is received in the pocket 1202, can enable the protective insert 204 to be removeably secured in relation to the pocket band 1201. Accordingly, once the protective insert 204 is received into the pocket 1202, the opening 1214 can contour about the approximately triangular shape of the protective insert 204 to retain or removeably secure the protective insert 204 in the pocket 1202.

As further illustrated, the pocket band 1201 with the inserted protective insert 204 is free floating with respect to the body 1104 of the protective headwear 1102, such that the pocket band 1201 can provide application-specific or precise fit and positioning of the plural protective inserts 204 for various head sizes (e.g., such as the head 1402 of the person 100) to effectively reduce and/or eliminate head injuries.

Moreover, the second thickness 1304 compared to the first thickness 1302 provides space in the pocket 1202 of the pocket band 1201 for the protective insert 204, facilitating an aesthetic, comfortable and inexpensive form-factor that can result in increased desirability and usability of protective headwear 102 to mitigate and/or eliminate head injuries.

Figure 18:
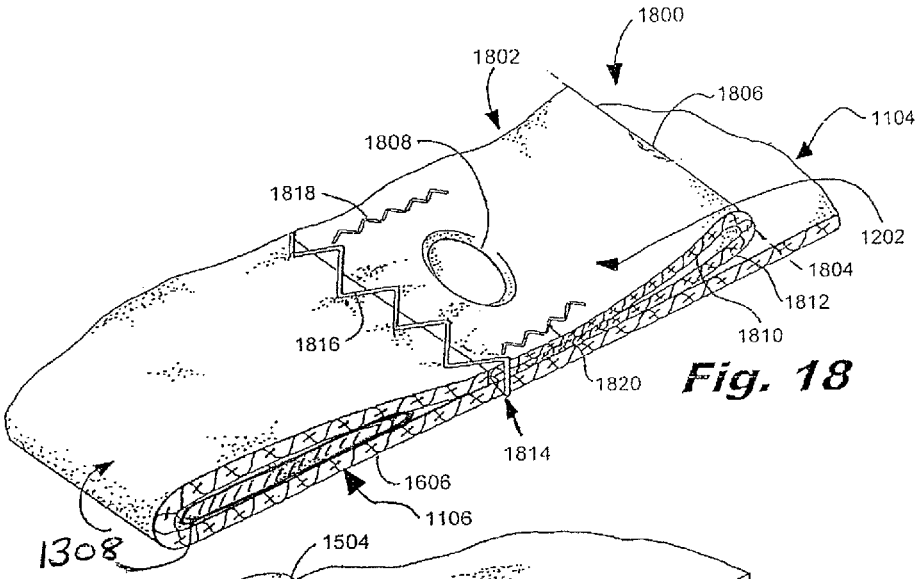
FIG. 18 illustrates an example method of manufacturing the example protective headwear of FIG. 11.

FIGS. 15-20 illustrate methods of manufacturing the example protective headwear 102, 1102 of FIGS. 1, 11, respectively. FIGS. 15-17, 19 and 20 illustrate an example method of manufacturing the example protective headwear 102 of FIG. 1. FIG. 18 illustrates an example method of manufacturing the example protective headwear 1102 of FIG. 11. The methods of manufacturing the protective headwear 102, 1102 of FIGS. 1, 11 will be described in greater detail below.

Figures 15, 16, 17:
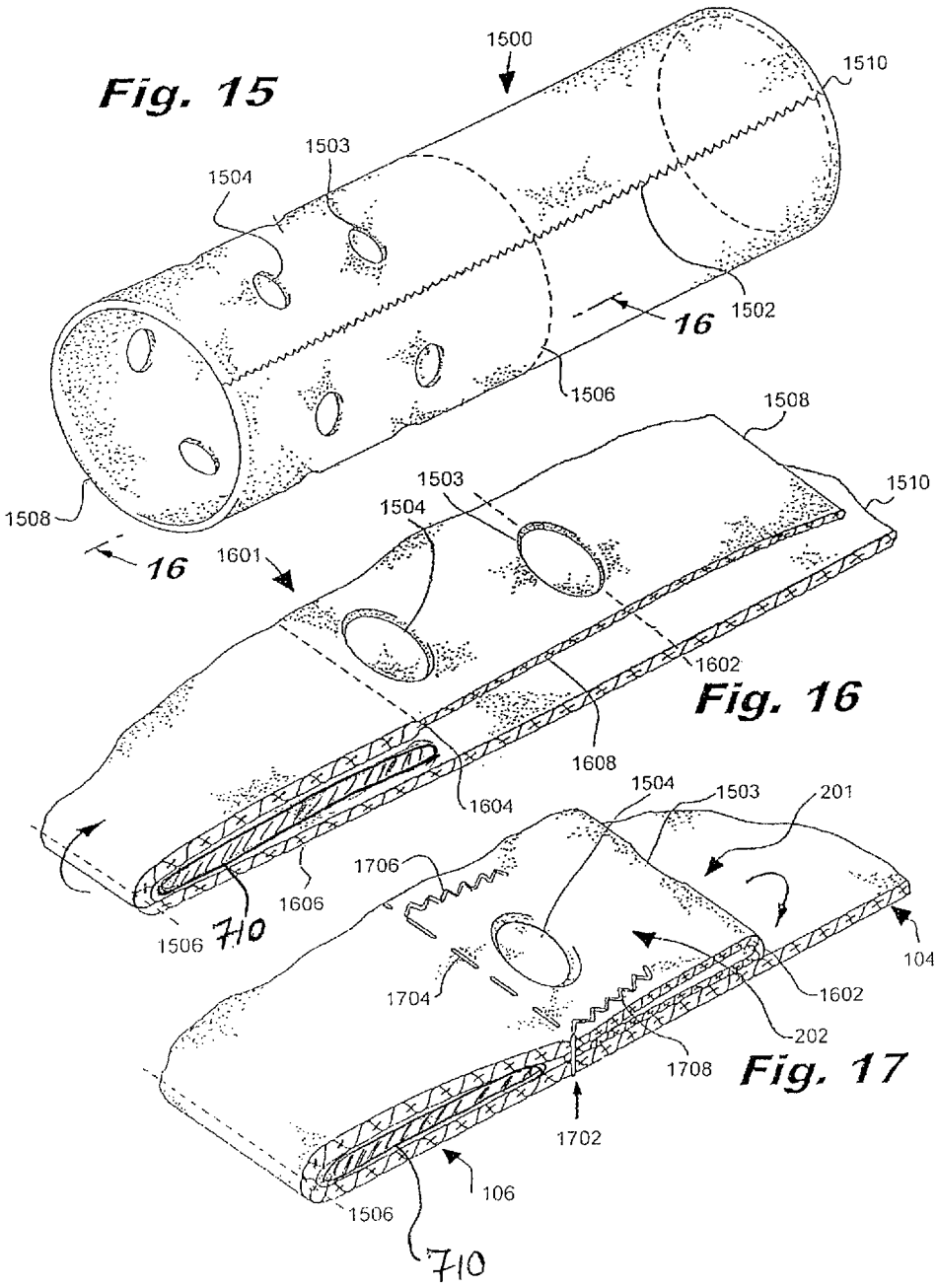
FIG. 15 illustrates construction of an example tube made of stretchable or elastic woven fabric (thread), which can be formed into the protective headwear of the first embodiment or the second embodiment of FIGS. 1 and 11, respectively.
FIG. 16 illustrates a first folding operation shown along a cross-section of the example tube of FIG. 15.
FIG. 17 illustrates a second folding operation and a stitching operation shown along the cross-section of the example tube of FIG. 15 to form the body, cuff 106 and pocket band of FIG. 1.

FIG. 15 illustrates construction of an example tube 1500 made of stretchable or elastic woven fabric (thread), which can be formed into the protective headwear 102, 1102, respectively. The tube 1500 is defined by edges 1508, 1510 and includes at least one plurality of openings 1503, 1504 about the tube 1500. In some embodiments, only a first plurality of openings 1503 is provided. In other embodiments, the first plurality of openings 1503 and second plurality of openings 1504 are provided. At least one or more of the edges 1508, 1510 can be finished or reinforced. For example, the edge 1508 can be finished. In some cases, one or more of the edges 1508, 1510 can be unfinished. For example, the edge 1510 can be unfinished.

In accordance with the method, the tube 1500 is initially woven or formed. In some embodiments, the tube 1500 can be weaved in a continuous weaving process (e.g., via a loom or another weaving machine) using a circular weave from the first edge 1508 to the second edge 1510. More specifically, the tube 1500 can be weaved to have a circumference of approximately 22 inches and a length (between edges 1508, 1510) from about 16 inches to about 20 inches. Alternative dimensions for the circumference and the length can be used. As will be described herein, the circumference of the tube 1500 can be gradually reduced or tapered along a portion of tube 1500 to provide a gradually reduced or tapered circumference of the pocket band 201, 1201 toward the apex or crown 206, 1216 of the headwear 102, 1102. During the same or continuous weaving process, the at least one plurality of openings 1503, 1504 can be formed or weaved into the tube 1500. The at least one plurality of openings 1503, 1504 can be finished or reinforced about the openings.

Moreover, the stretchability or elasticity of different portions of the headwear 102, 1102 can be varied during the same or continuous weaving process. In some embodiments, a first portion of the tube 1500 that will form the body 104 and cuff 106 can be woven from a woven fabric (thread) and/or a weave that provides a first order (level) of stretchability or elasticity, while a second portion of the tube 1500 that will form the pocket band 201 and the at least one plurality of openings 1503, 1504 openings can be woven from a woven fabric (thread) and/or a weave that provides a second order (level) of stretchability or elasticity. The second level can be more (or less) stretchable or elastic than the first level. In other embodiments, a third portion of the tube 1500 in which the at least one plurality of openings 1503, 1504 will formed can be woven from a woven fabric (thread) and/or a weave that provides a third order (level) of stretchability or elasticity. The third level can be more (or less) stretchable or elastic than the second level (and/or the first level).

In other embodiments of the method, the tube 1500 can be formed as follows. More specifically, the tube 1500 (including the at least one plurality of openings 1503, 1504) initially can be weaved as a flat material in a continuous weaving process (e.g., via a loom or another weaving machine) from the first edge 1508 to the second edge 1510. The edges 1508, 1510 can be similarly finished or unfinished. During the same or continuous weaving process, the at least one plurality of openings 1503, 1504 can be formed or weaved into the tube 1500 (flat material) from a third edge to a fourth edge. The at least one plurality of openings 1503, 1504 can be finished or reinforced about the openings. Thereafter, the flat material can be rolled and the third and fourth edges joined in a stitching operating by a stitching 1502 to form the tube 1500, which can have a circumference of approximately 22 inches and a length (between edges 1508, 1510) from about 16 inches to about 20 inches. Alternative dimensions for the circumference and the length can be used.

Figure 20:
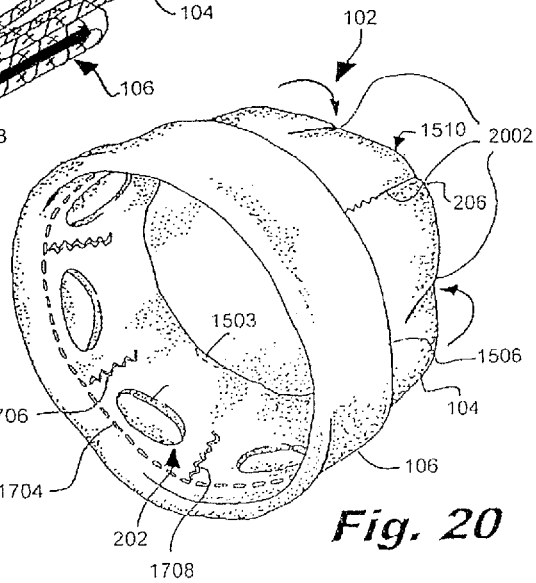
FIG. 20 illustrates a crown forming operation to complete the protective headwear of FIGS. 1 and 11.

Reference 1506 indicates a first fold as will be described in greater detail below. The edge of the first fold 1506 will form the edge of the cuff 106, as illustrated in FIG. 20 and described in greater detail below.

FIG. 16 illustrates a first folding operation shown along a cross-section of the example tube 1500. References 1602, 1604 indicate a second fold and a third fold, respectively, as will be described in greater detail below. References 1606, 1608 indicate a first portion and a second portion of the tube 1500, respectively, as will also be described in greater detail below. The first portion 1606 extends from the edge 1510 to the third fold 1604. The second portion 1608 extends from the third fold 1604 to the edge 1508.

As illustrated, the edge 1508 is folded to the interior of the tube 1500 at the first fold 1506 to provide a first folded portion 1601 that extends from the first fold 1506 to the edge 1508.

The first portion 1606 of the tube 1500 can be weaved from a woven fabric (thread) and/or a weave that provides a first order (level) of stretchability or elasticity, while the second portion 1608 of the tube 1500 that will form the pocket band 201 and the at least one plurality of openings 1503, 1504 openings can be weaved from a woven fabric (thread) and/or a weave that provides a second order (level) of stretchability or elasticity.

As further illustrated in FIG. 16, the first portion 1606 can have a first thickness, while the second portion 1608 can have a second thickness (e.g., the second thickness of the second portion 1608 approximately half or less the first thickness of the first portion 1606). Moreover, the circumference of the second portion 1608 can be gradually reduced or tapered along a first part of the tube 1500 between the second fold 1602 and third fold 1604. Similarly, the circumference of the second portion 1608 can be gradually and reciprocally increased from the finally reduced circumference to the original circumference of tube 1500 along a second part of the tube 1500 between second fold 1602 and edge 1508, such that when the second portion 1608 is folded at the second fold 1602, the reduced circumferences of first and second parts approximate each other.

In some embodiments, a separate insertable cuff element 710 (e.g., made of foam rubber, or other similar material) that is pliable and lightweight can be incorporated along portion 1606, from and between first fold 1506 and third fold 1604, and along the circumference of tube 1500, which will form the cuff 106. The thickness, height and diameter of the cuff element 710 can vary based on dimensions of the cuff 106 to formed, as shown in greater detail in FIG. 17.

FIG. 17 illustrates a second folding operation and a stitching operation shown along the cross-section of the example tube 1500 to form the body 104, cuff 106 and pocket band 201.

As illustrated, during the second folding operation the edge 1508 again is folded to the interior of the tube 1500 at approximately the second fold 1602 to approximately the third fold 1604, such that the plurality of openings 1503 are approximately at the second fold 1602. In various embodiments, the opening 1503 can be offset from the second fold 1602 by modifying the length of the first folded portion 1601 and/or the second potion 1608.

During the stitching operation, a base stitching 1704 is stitched at location 1702 through the second portion 1608 and the first portion 1606 of the tube 1500, such that the edge 1508 is secured between the second portion 1608 and the first portion 1606. This forms the pocket band 201 about the circumference of the tube 1500, as illustrated in FIG. 20. As described herein, the pocket band 201 can now have a gradually-reduced circumference along its height toward the apex or crown 206. This also forms the cuff 106 about the circumference of the tube 1500. The base stitching 1704 secures the insertable cuff element 710 inside the cuff 106 in those embodiments that provide the insertable cuff element 710.

Further with reference to the stitching operation, at each of the at least one opening 1503, 1504 (e.g., at each pair of openings 1503, 1504 or at each opening 1503 if only one opening is provided), side stitchings 1706, 1708 are stitched through the folded second portion 1608 only to form each of the pockets 202 that a free floating with respect to the first portion 1606. The side stitchings 1706, 1708 extend from about the base stitching 1704 partially towards the fold 1602 and can be angled with respect to one another in order to approximate the protective insert 204.

FIG. 18 illustrates an example method of manufacturing the example protective headwear 1102 of FIG. 11. More specifically, the tube 1500 of FIG. 15 can be modified such that only the first portion 1606 is provided (weaved), but the second portion 1608 that extends from the third fold 1604 is not provided (weaved) as part of the tube 1500. The tube 1500 as modified (e.g., the first portion 1606) is the folded at the first fold 1506 as shown in FIG. 16. In some embodiments, a separate insertable cuff element 1308 (e.g., made of foam rubber, other similar material) that is pliable and lightweight can be incorporated along portion 1606, from and between first fold 1506 and third fold 1604, and along the circumference of tube 1500 as modified, which will form the cuff 1106. The thickness, height and diameter of the cuff element 1308 can vary based on dimensions of the cuff 106 to formed, as shown in greater detail in FIG. 19.

Thereafter, a separately formed pocket band 1802—including at least one plurality of openings 1806, 1808 and folded about a fold 1804 to form a first portion 1810 and second portion 1812—is abutted or placed adjacently to the folded first portion 1606 at about location 1814. As described herein, the separately formed pocket band 1802 can similarly be formed such that it has a gradually-reduced circumference along its height toward the apex or crown 206. Each of the first and second portions 1810, 1812 can have a thickness that is reduced (e.g., half or smaller) than the thickness of the tube 1500 as modified (e.g., thickness of the first portion 1606).

During the stitching operation, a base stitching 1816 is stitched at the location 1814 through the folded tube 1500 (as modified) and through the portions 1810, 1812, such that the pocket band 1802 and the cuff 1106 are attached to one another about the circumference of the tube 1500 as modified. The base stitching 1816 secures the insertable cuff element 1308 inside the cuff 1106 in those embodiments that provide the insertable cuff element 1308.

Further with reference to the stitching operation, at each of the at least one opening 1806, 1808 (e.g., at each pair of openings 1806, 1808 or at each opening 1806 if only one opening is provided), side stitchings 1818, 1820 are stitched through the first and second portions 1810, 1812 of the pocket band 1802 to form each of the pockets 1202. The pocket band 1802 can be considered the pocket band 1201 of FIG. 12. The side stitchings 1818, 1820 can extend from about the base stitching 1816 partially towards the fold 1804 and can be angled with respect to one another in order to approximate the protective insert 204.

Figure 19:
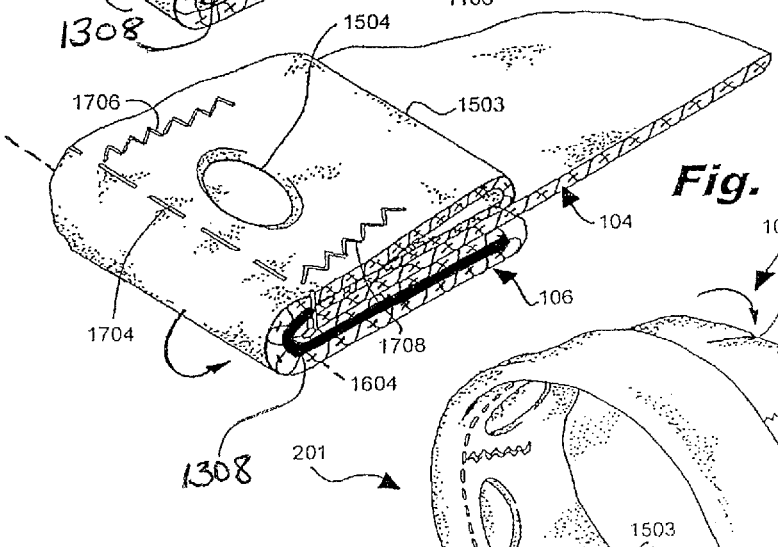
FIG. 19 illustrates a third optional folding operation shown along the cross-section of the example tube of FIG. 17 or 18 to form the cuff of the example protective headwear of FIG. 1 or 11, respectively.

FIG. 19 illustrates a third folding operation shown along the cross-section of the example tube 1500 to form the cuff 106 of the example protective headwear 102 of FIG. 1. More specifically, the cuff 106 can be folded over the body 104 at the fold 1604. This folding operation is optional, as the cuff 106 can remain un-cuffed. Moreover, if the cuff 106 is omitted, the third folding operation is inapplicable.

Similarly in relation to the protective headwear 1102 of FIG. 11, the cuff 1106 can be folded over the body 1104 at the fold 1814. Again, this folding operation is optional, as the cuff 1106 can remain un-cuffed. Moreover, if the cuff 1106 is omitted, the third folding operation is inapplicable FIG. 20 illustrates a crown forming operation. More specifically, the edge 1510 is cut about the circumference of the tube 1500 from the edge 1510 toward the edge 1508 and access material (e.g., triangular portions) is removed to reduce the circumference of the tube 1500. The remaining material is stitched at stitchings 2002 such that a crown 206 can be formed to complete the protective headwear 102 of FIG. 1.

Similarly in relation to the protective headwear 1102 of FIG. 11, the edge 1510 is cut about the circumference of the tube 1500 as modified from the edge 1510 toward the fold 1604 (FIG. 16) and access material (e.g., triangular portions) is removed to reduce the circumference of the tube 1500. The remaining material is stitched at stitchings 2002 such that a crown 1216 can be formed to complete the protective headwear 1102 of FIG. 11.

As described herein, the pocket band 201, 1201 can have a gradually-reduced circumference along its height toward the apex or crown 206, 1216, such that improved form-fit and aesthetic look of the headwear 102, 1102 with respect to the head of the person 100 can be provided. The reduced or tapered circumference of the pocket band 201, 1201 conforms the protective inserts 204 to the head of the person 100 and prevents the protective inserts 204 from visibly pressing against or bulging out with respect to the body 104, 1104 of the headwear 102, 1102.

Figure 21:
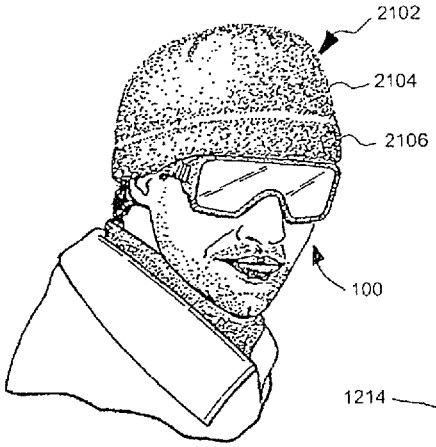
FIG. 21 illustrates a person wearing an example protective headwear in accordance with a third embodiment.

FIG. 21 illustrates a person 100 wearing an example protective headwear 2102 in accordance with a third embodiment. The protective headwear 2102 is configured to provide a combination of a significant protective function in an aesthetic form-factor, which improves desirability for wearing the protective headwear 2102. More superficially, the protective headwear 2102 provides the appearance of an aesthetic stretchable hat, while at the same time providing a significant protective function, which encourages the use of the protective headwear 2102 and reduces the potential for head injuries.

The protective headwear 2102 can be made from man-made/synthetic materials, natural materials, and/or blended combinations thereof. For example, wool, cotton, acrylic, nylon, other natural/synthetic materials, and combinations thereof can be used. The protective headwear 2102 is shown to include a body 2104 and a cuff 2106. The cuff 2106 can be formed by cuffing or rolling an end portion of the body 2104 one or more times to the interior of the body 2104 to a thickness that approximates a thickness of the pocket band and protective insert(s) as will be described in greater detail below.

Accordingly, the body 2104 is configured to fit precisely and aesthetically over a person's head and to provide a protective function against head injury resulting from activities in which the person 100 engages. The activities for which the protective headwear 2102 will find implementation can include, for example, rollerblading, biking, hiking, skateboarding, touch football, soccer, field hockey, girls lacrosse, rock climbing, skiing, snowboarding, and ice-skating, as well as other sports and activities as described herein.

Figure 22:
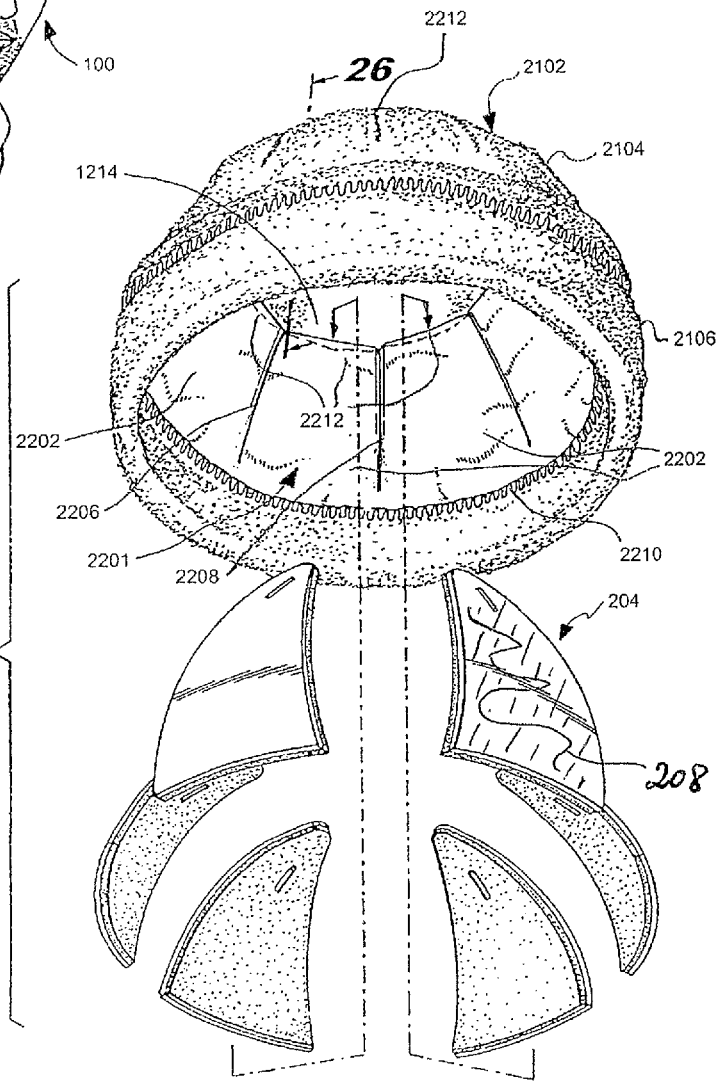
FIG. 22 illustrates the construction of the example protective headwear of FIG. 21.

FIG. 22 illustrates the construction of the example protective headwear 2102 of FIG. 21. The protective headwear 2102 includes a pocket band 2201 and a plurality of protective inserts 204. In this third embodiment, the pocket band 2201 can be provided (e.g., weaved) separately from the headwear 2102 and then attached (e.g., stitched) to the protective headwear 2102.

Moreover, in various other embodiments the pocket band 2201 can be manufactured or provided as a liner, for example, which can remain separate from the protective headwear 1102, such that the protective headwear 2102 can be completed when the protective headwear 1102 (or another cap, hat or the like) is worn over the combination of the liner (e.g., pocket band 2201) and the protective inserts 204.

Now with further reference to FIG. 22, the pocket band 2201 is disposed about at least a portion of the interior of the protective headwear 2102 and is configured to receive and retain the protective inserts 204 in a predetermined configuration that provides a protective function to the person's head when the person 100 wears the protective headwear 2102. The pocket band 2201 extends from the base stitching 2210 of the protective headwear 2102 towards the apex or crown 2212 of the protective headwear 2102 such that the protective function can be provided to the head of the person 100. The protective headwear 2102, and more particularly the pocket band 2201 coupled with protective inserts 204, is configured to at least partially or fully cover the frontal, parietal, temporal and occipital part of the person's head.

Moreover, the pocket band 2201 provides a gradually reduced or tapered circumference along a portion of its height toward the apex or crown 2212, such that improved form-fit and aesthetic look of the headwear 2102 with respect to the head of the person 100 can be provided. The reduced or tapered circumference of the pocket band 2201 conforms the protective inserts 204 to the head of the person 100 and prevents the protective inserts 204 from visibly pressing against or bulging out with respect to the body 2104 of the headwear 2102.

The pocket band 2201 includes a plurality of pockets 2202, each of which is defined by the side stitchings 2206, 2208 and the base stitching 2210. The construction of the side stitchings 2206, 2208 will be explained in greater detail below. Each of the pockets 2202 is configured (e.g., sized and dimensioned) to receive and retain a respective protective insert 204, such that the plurality of protective inserts 204 can be disposed in the predetermined configuration in the pocket band 2201 of the protective headwear 2102. In some embodiments, six (6) pockets 2202 are provided in the pocket band 2201. In other embodiments, there can be four (4) to twelve (12) pockets 2202. Fewer or greater number of pockets 2202 can be provided in alternate embodiments.

The plurality of pockets 2202 are disposed adjacently about the pocket band 2201 such that the protective inserts 204 can be adjacently disposed (e.g., one next to the other), providing an almost continuous protective function about the protective headwear 2102. In some embodiments, the pockets 2202 can be equidistantly disposed about the pocket band 2201. In other embodiments, the pockets 2202 can be disposed at different locations about the pocket band 2201 based on the size and dimension of the respective protective inserts to be received into the pockets 2202.

Each pocket 2202 includes an opening 2212 configured to receive the protective insert 204 into the pocket 2202. The opening 1212 can be disposed at a top-most extent 1214 of the pocket band 2201. In some embodiments, a second opening can be provided in each pocket 2202 disposed at distance above the base stitching 2210 and below the opening 2212. The second opening can be approximately the same or smaller than opening 2212. This distance can be varied along the height of the pocket band 2201. The second opening can be offset from the top-most extent 1214 of the pocket band 2201, to either the front or the back of the pocket band 2201.

The openings 2212 are defined by the side stitching 2206, 2208. The openings 2212 (and the second openings) are stretchable in order to receive and retain the protective inserts 204 in the pockets 2202 of the pocket band 2201. The openings 2212 can be formed to be more (or less) stretchable than the second openings.

The side stitchings 2206, 2208 of each pocket 2202 extend approximately from the base stitching 2210 and along the height of the pocket band 1201 towards the apex or crown 2216 of the protective headwear 2102. In other embodiments, the side stitchings 2206, 2208 can extend partially or fully to the top-most extent 2214 of the pocket band 2201.

Each of the side stitchings 2206, 2208 is formed by defining a v-shaped pattern disposed at an offset from a lower-most extent (not shown) of the pocket band 2201 toward the top-most extent 2214. Each of the stitchings 2206, 2208 thus secures respective sides of the v-shaped pattern to each other, generating triangular excised portions (not shown) that gradually reduce or taper the circumference of the pocket band 2201 along its height toward the apex or crown 2212, such that improved form-fit and aesthetic look of the headwear 2102 with respect to the head of the person 100 can be provided.

As a result, the side stitchings 2206, 2208 are approximately angled towards one another and towards the apex or crown 1216 of the protective headwear 2102. More specifically, the stitchings 2206, 2208 can be angled to approximate and accommodate the angulation of each protective insert 204, such that the plural protective inserts 204 can be retained in a predetermined configuration with respect to one another in the respective pockets 2202 and can provide an almost continuous protective function and can conform to the person's head when the person 100 wears the protective headwear 2102.

The base stitching 2210 (z-stitch pattern or anther stitch pattern) extends along the circumference of the pocket band 2201. The base stitching 1210 is configured to secure a portion of the pocket band 2201 that extends from its lower-most extent (not shown) to about the side stitchings 2206, 2208 to the interior of the protective headwear 2102 as described in greater detail below. The base stitching 2210 is further configured to provide a base or seat for each of the protective inserts 204, approximating and accommodating the base of each protective insert 204, such that the plural protective inserts 204 can be retained in a predetermined configuration with respect to one another in the respective pockets 2202 and can provide an almost continuous protective function to the person's head when the person 100 wears the protective headwear 2102.

The protective inserts 204 are configured to be disposed adjacently to one another in the respective pockets 2202 of the pocket band 2201, providing an almost continuous protective function about the protective headwear 2102. The protective inserts 204 are independently situated or disposed in the respective pockets 2202 of the pocket band 2201 and can conform to the contours of the person's head by the gradually reduced or tapered circumference of the pocket band 2201 and as the protective headwear 1102 stretches about the head of the person 100.

The protective inserts 204 are described in greater detail with reference to FIGS. 4-6 hereinabove. In some embodiments, six (6) protective inserts 204 can be provided. In other embodiments, there can be four (4) to twelve (12) protective inserts 204. Fewer or greater number of protective inserts 204 can be provided in different embodiments based on the number of pockets 2202.

As described hereinabove, the protective inserts 204 can also include adhesive layers 208 to enable the protective inserts 208 to be removeably secured in the pocket band 2201 of headwear 2102 or on the interior of other headwear that may not be provided with the pocket band 2201.

Figure 23:
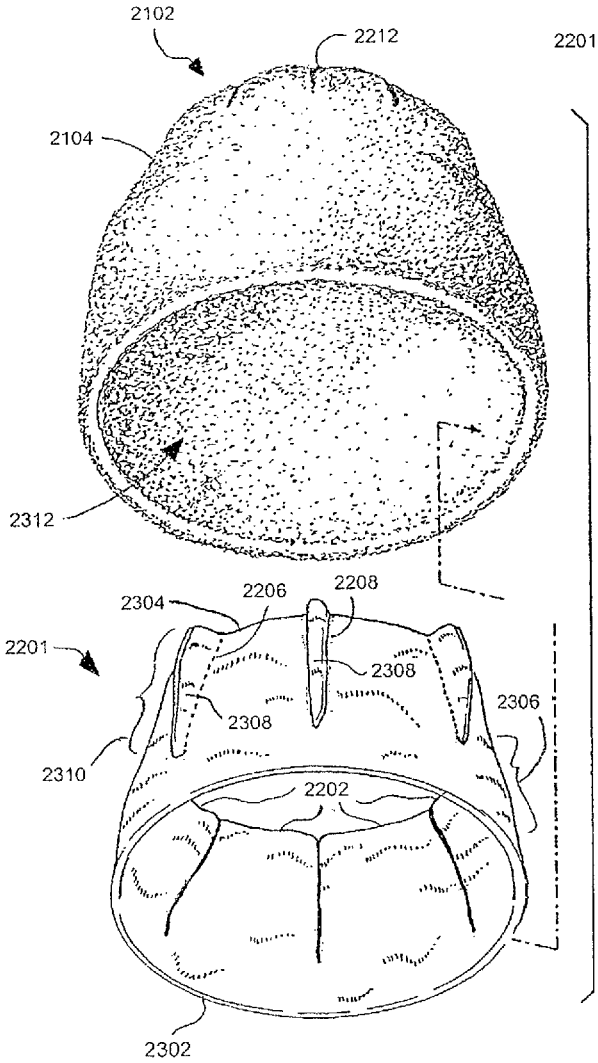
FIG. 23 illustrates the construction of the example pocket band in the protective headwear illustrated in FIG. 22.

FIG. 23 illustrates the construction of the example pocket band 2201 in the protective headwear 2102 illustrated in FIG. 22.

The pocket band 2201 has a first circumference 2302 and a second smaller circumference 2304. The first circumference is about the circumference of the opening 2312 in the body 2104 of protective headwear 2102 (e.g., about 23 inches). The second circumference 2304 is approximately the circumference of the body 2104 about the apex or crown 2212 of the protective headwear 2102 (e.g., about 15 inches). The first and second circumferences 2302, 2304 can have different dimensions and proportions to one another for variously-sized heads.

The pocket band 2201 includes a first portion 2306 having the first circumference 2302 and a second portion 2310 having a gradually-reduced circumference extending from the first circumference 2302 to the smaller second circumference 2304 along the height of the second portion 2310. The overall height of the pocket band 2201 is approximately 4.5 inches, with the first portion 2306 being about 0.5 inches and the second portion 2310 being about 4.0 inches. The gradually-reduced circumference can be obtained by defining and stitching v-shaped patterns about the pocket band 2201 via side stitchings 2206, 2208. Specifically, each of the stitchings 2206, 2208 secures respective sides of the v-shaped pattern to each other, generating triangular excised portions 2308 that gradually reduce or taper the circumference of the pocket band 2201 along the height of the second portion 2310 toward the apex or crown 2212. The gradation of the reduction in the circumferences 2302, 2304 can be achieved by selection of the width and height of the v-shaped pattern.

The cuff 2106 (shown in FIGS. 21 and 22) can be formed by cuffing or rolling an end portion of the body 2104 (illustrated by the arrows) one or more times to the interior of the body 2104 to a thickness that approximates a combined thickness of the pocket band 2201 and protective insert(s) 204. After the cuff 2106 is formed, the first portion 2306 of the pocket band 2201 is inserted or disposed between the cuff 2106 and the body 2104 to a depth such that the cuff 2106 is disposed over the pocket band 2201 to approximately the stitchings 2206, 2208. Thereafter, the base stitching 2210 is applied to secure the pocket band 2201 and the cuff 2106 to the body 2104.

Figure 24:
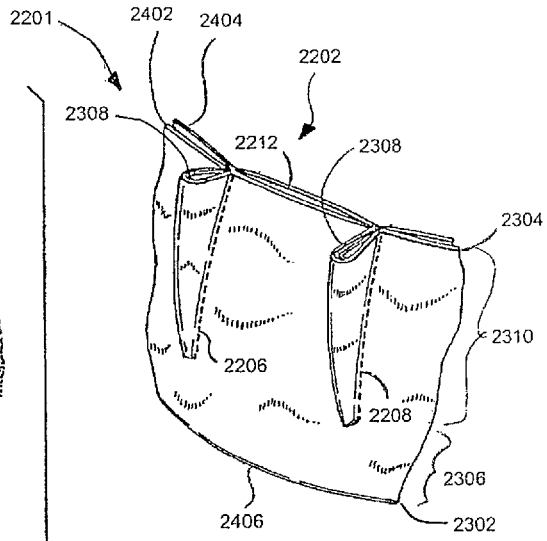
FIG. 24 illustrates the construction of an example pocket in the pocket band of the protective headwear of FIG. 21.

FIG. 24 illustrates the construction of an example pocket 2202 in the pocket band 2201 of the protective headwear of FIG. 21.

The pocket band 2201 can be formed by folding a material having a first end 2402 and a second end 2404 in half about a fold or crease 2406. The material can be a sheet having a length (e.g., about 23 inches) and a width (e.g., about 9.0 inches), or the material can be a continuous tube having a circumference of 23 inches and a height of (e.g., about 4.5 inches). The material can be a stretchable or elastic woven fabric (thread), or other conventional and stretchable material.

Furthermore, the pockets 2212 can be formed by defining v-shaped patterns about the pocket band 2201 and securing respective sides of the v-shaped patterns to each other via side stitchings 2206, 2208.

As illustrated in FIG. 24, section 2306 has the first circumference 2302 and section 2310 has a gradually reduced circumference extending along the height of section 2310 to the second circumference 2304. The triangular excised portions 2308 gradually reduce the circumference of the second section 2310, and can conform the protective inserts 204 to the head of the person 100 to prevent the protective inserts 204 from visibly pressing against or bulging out with respect to the body 2104 of the headwear 2102.

Figure 25:
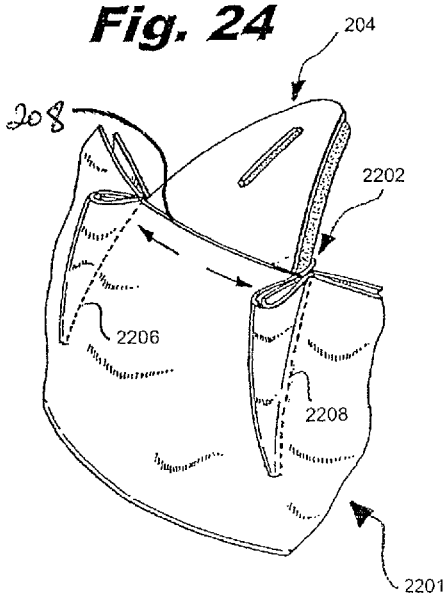
FIG. 25 illustrates the protective insert retained in the example pocket of the pocket band illustrated in FIG. 24.

FIG. 25 illustrates the protective insert 204 retained in the example pocket 2202 of the pocket band 2201 illustrated in FIG. 24.

As illustrated, the side stitchings 2206, 2208 conform the shape of pocket 2202 to the shape of the protective insert 204, as well as conforming the shapes of the pocket band 2201 to the shape of the head of the person 100 and the shape of protective headwear 2102 toward its apex or crown 2212 (shown in FIG. 23). The adhesive layer 208 illustrated in FIG. 22, if provided atop a portion of the protective insert 204 that is received in the pocket 2202, can enable the protective insert 204 to be removeably secured in relation to the pocket band 2201.

Figure 26:
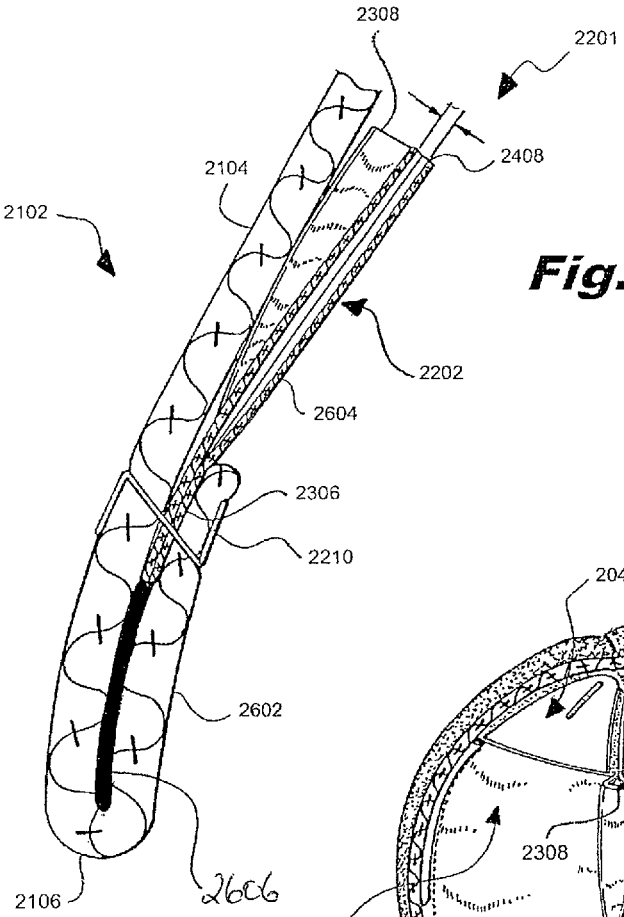
FIG. 26 illustrates a cross-section of the example protective headwear of FIG. 21.

FIG. 26 illustrates a cross-section of the example protective headwear 2102 of FIG. 21.

The pocket band 2201 can be weaved in a first weaving process on a loom or another automated weaving machine, and can be weaved from a thread and/or weave of a second thickness 2604.

The body 2104 and cuff 2106 can be weaved in a second weaving process on a loom or another automated weaving machine, and the pocket band 2201 can then be attached to the body 2104 and cuff 1106 via base stitching 2210. In some embodiments, a separate insertable cuff element 2606 (e.g., made of foam rubber, or other material) that is pliable and lightweight can be incorporated inside of and along the circumference of the cuff 2106. The thickness, height and diameter of the cuff element 2606 can vary based on dimensions of the cuff 2106 of the headwear 2102. The base stitching 2210 secures the insertable cuff element 2606 inside the cuff 106 in those embodiments that provide the insertable cuff element 2606.

The first and second weaving processes can be contemporaneous, sequential or can be performed at various times. The body 2104 and cuff 2106 of the protective headwear 2102 can be weaved from a thread and/or weave of a first thickness 2602.

The second thickness 2604 can be reduced from the first thickness 2602 (e.g., approximately by half or smaller from the first thickness) such that sufficient space can be provided in the pocket 2202 of the pocket band 2201 to receive a protective insert 204, providing an aesthetic, comfortable and inexpensive form-factor that can result in increased desirability and usability of protective headwear 2102 to mitigate and/or eliminate head injuries. The first and second thicknesses 2602, 2604 can be same as or different than the thickness described herein in relation to other embodiments.

After the second weaving process, the pocket band 2201 is attached or secured by second portion 2306 between cuff 2106 and body 2104 to the protective headwear 2102 to form the pocket band 2201, such that the protective headwear 2102 can receive and retain plural protective inserts 204 in the pockets 2202 of the pocket band 2201.

As illustrated, the pocket band 2201 is free floating with respect to the body 2104 of the protective headwear 2102, such that the pocket band 2201 can provide application-specific or precise fit and positioning of plural protective inserts 204 for various head sizes to effectively reduce and/or eliminate head injuries.

As further illustrated, the second thickness 2604 can be reduced from the first thickness 2602 such that sufficient space can be provided in the pocket 2202 of the pocket band 2201 to receive a protective insert 204, providing an aesthetic, comfortable and inexpensive form-factor that can result in increased desirability and usability of protective headwear 2102 to mitigate and/or eliminate head injuries.

It is noted that the triangular excise portions 2308 is shown unfolded for illustration purposes, but in operation the excise portions 2308 would fold to one side or another such that the pocket 2202 (and more particularly the pocket band 2201) can be disposed flush to the body 2104.

Figure 27:
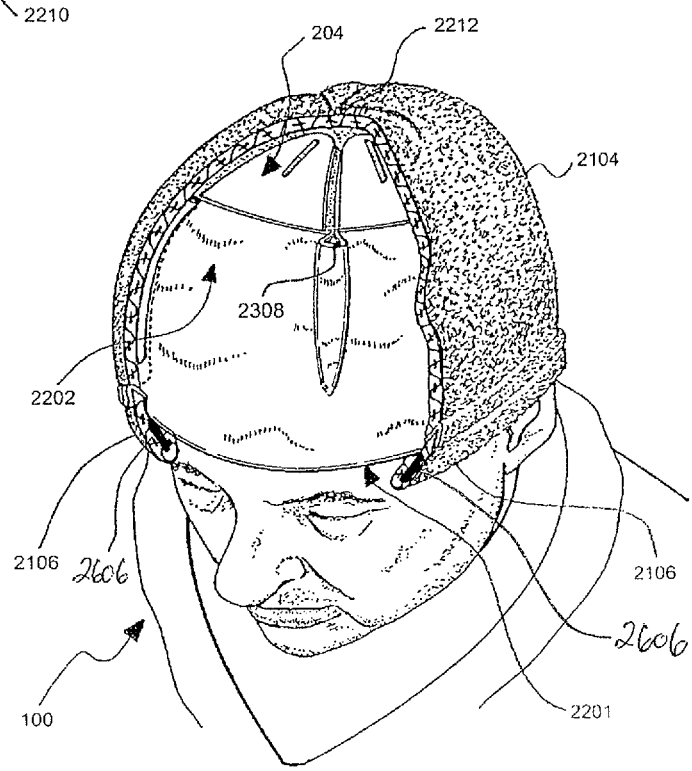
FIG. 27 illustrates a person wearing the protective headwear of FIG. 21 cutaway to reveal the protective insert retained by a pocket band in relation to the body and the cuff of the protective headwear.

FIG. 27 illustrates a person 100 wearing the protective headwear 2102 of FIG. 21 cutaway to reveal the protective insert 204 retained by a pocket band 2201 in relation to the body 2104 and the cuff 2106. In some embodiment, the cuff 2106 can incorporate insertable cuff element 2606.

Plural protective inserts 204 are secured by the pocket band 2201—and more particularly, by the respective pockets 2202 of the pocket band 2201—around the head of the person 100 and conform or contour to the head of the person 100, providing a protective function to the frontal, parietal, temporal and occipital parts of the person's head.

The protective inserts 204 provide an almost continuous protective function amongst and between the protective inserts 204, about the circumference of the protective band 2201 and through to the apex or crown 2212 of the protective headwear 2102.

Figure 28:
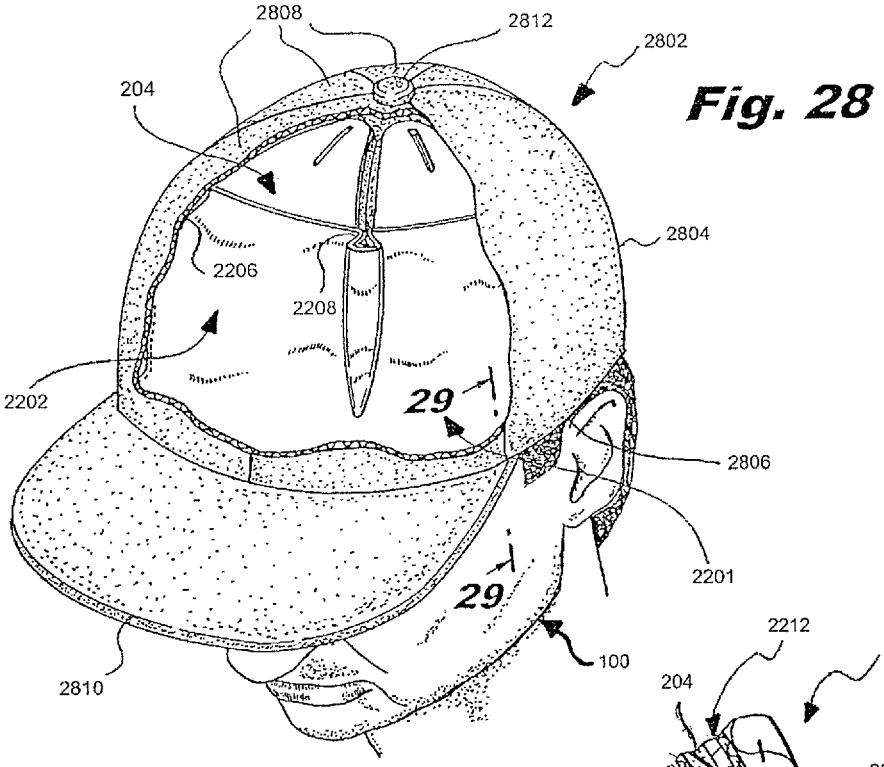
FIG. 28 illustrates a person wearing an example protective headwear in accordance with a fourth embodiment.

FIG. 28 illustrates a person 100 wearing an example protective headwear 2802 in accordance with a fourth embodiment, cutaway to reveal the protective insert 204 retained by a pocket band 2201 in relation to the body 2804 and the band 2806.

The protective headwear 2102 is configured to provide a combination of a significant protective function in an aesthetic form-factor, which improves desirability for wearing the protective headwear 2102. More superficially, the protective headwear 2802 provides the appearance of an aesthetic baseball cap, while at the same time providing a significant protective function, which encourages the use of the protective headwear 2802 and reduces the potential for head injuries.

The protective headwear 2802 can be made from man-made/synthetic materials, natural materials, and/or blended combinations thereof. For example, wool, cotton, acrylic, nylon, other natural/synthetic materials, and combinations thereof can be used. The protective headwear 2802 is shown to include a body 2804, band 2806 (shown in FIG. 29) and visor 2810. In some embodiments, the body can be made panels 2808 secured (e.g., stitched) together. A button can be provided at the apex or crown 2812 of the protective headwear 2802, over the join between the panels 2808. Alternative conventional or to be developed designs of the panels 2808 can be used.

The band 2806 (shown in FIG. 29) extends along the interior lower portion of the body 2804. The band 2806 can be stretchable or elastic. The first portion 2306 of the pocket band 2201 is inserted or disposed between the band 2806 and the body 2804 to a depth such that the band 2806 is disposed over the pocket band 2201 to approximately the stitchings 2206, 2208. Thereafter, base stitching 2904 (shown in FIG. 29) is applied to secure the pocket band 2201 and the band 2806 to the body 2804.

Accordingly, the body 2804 is configured to fit precisely and aesthetically over a person's head and to provide a protective function against head injury resulting from activities in which the person 100 engages. The activities for which the protective headwear 2102 will find implementation can include, for example, rollerblading, biking, hiking, skateboarding, touch football, soccer, field hockey, girls lacrosse, rock climbing, skiing, snowboarding, ice-skating, and baseball, as well as other sports and activities as described herein.

Figure 29:
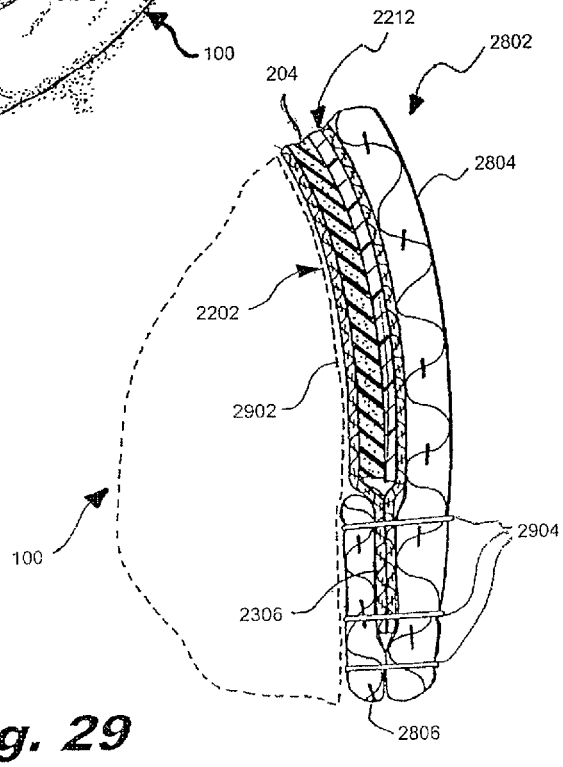
FIG. 29 illustrates a cross-section of the example protective headwear of FIG. 28.

FIG. 29 illustrates a cross-section of the example protective headwear 2802 of FIG. 28 with the protective insert 204 disposed in the pocket 2202.

As illustrated, base stitching 2904 provides a base to retain the protective insert 204 in the pocket 2202. As described previously herein, the protective insert 204 is inserted into the pocket 2202 of the pocket band 2201 through either the opening 2212.

The openings 2212 are stretchable to receive the protective inserts 204 into respective pockets 2202 (e.g., based on the stretchable material from which the pocket band 2201 is made). Accordingly, once the protective inserts 204 are received into the pockets 2202, the opening 2212 can contour about the approximately triangular shape of the protective insert 204 to retain or secure the protective insert 204 in the pockets 2202.

As further illustrated, the pocket band 2201 with the inserted protective inserts 204 is free floating with respect to the body 2104 of the protective headwear 2802, such that the pocket band 2201 can provide application-specific or precise fit and positioning of the plural protective inserts 204 for various head sizes (e.g., such as the head 2902 of the person 100) to effectively reduce and/or eliminate head injuries.

Moreover, one or more stitchings 2904 can be used to secure the pocket band 2201 between the body 2804 and the band 2806 of the protective headwear 2802.

Thus, a form-fitting protective headwear and a method of manufacturing the form-fitting protective headwear have been described. Although specific example embodiments have been described, it will be evident that various modifications and changes may be made to these embodiments without departing from the broader spirit and scope of the invention.

Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments shown are described in sufficient detail to enable those skilled in the art to practice the teachings disclosed herein. Other embodiments may be utilized and derived therefrom, such that structural and logical substitutions and changes may be made without departing from the scope of this application.

The foregoing detailed description, therefore, is not to be taken in a limiting sense, and the scope of various embodiments is defined only by the appended claims, along with the full range of equivalents to which such claims are entitled.

Although specific embodiments have been shown and described herein, it should be appreciated that any arrangement calculated to achieve the same purpose may be substituted for the specific embodiments shown. This application is intended to cover any and all adaptations or variations of various embodiments. Combinations of the above embodiments and other embodiments not specifically described herein, will be apparent to those of skill in the art upon reviewing the above description.

The Abstract is provided to comply with 37 C.F.R. §1.72(b) and will allow the reader to quickly ascertain the nature of the technical disclosure of this application. It is submitted with the understanding that it will not be used to interpret or limit the scope or meaning of the claims.

In the foregoing detailed description, various features may be grouped together in a single embodiment for the purpose of streamlining the disclosure of this application. This method of disclosure is not to be interpreted as reflecting that the claimed embodiments have more features than are expressly recited in each claim. Rather, as the following claims reflect, inventive subject matter lies in less than all features of a single disclosed embodiment.

Moreover, it is contemplated that the features or components of various embodiments described herein can be combined into different combinations that are not explicitly enumerated in the foregoing detailed description and that such combinations can similarly stand on their own as separate example embodiments that can be claimed.

The invention claimed is:

1. A protective headwear, the headwear comprising:

a body having an opening and a crown, the body configured to fit a head of a person;

a pocket band extending about the opening to an interior of the body and partially toward the crown, the pocket band free floating with respect to the body and configured to fit the head of the person, the pocket band including a plurality of pockets disposed about a base stitching that secures the pocket band to the body, at least one pocket of the plurality of pockets comprising a stretchable opening at a distance from the base stitching;

a cuff extending about the body and away from the crown, the cuff incorporating a cuff element inside the cuff; and a plurality of protective inserts configured to be received into the plurality of pockets to provide a protective function to the head of the person, the protective inserts being disposed adjacently to one another about the pocket band and extending from the base stitching of the pocket band to the crown of the body, wherein the stretchable opening of the at least one pocket is configured to receive a protective insert of the plurality of protective inserts into the at least one pocket and to retain the protective insert in the at least one pocket such that a portion of the protective insert extends out of the at least one pocket toward the crown.

2. The protective headwear of claim 1, wherein the cuff element is pliable.

3. The protective headwear of claim 1, wherein the cuff element is made of foam rubber.

4. The protective headwear of claim 1, wherein the pocket band is monolithically formed from the body and stitched to the body by the base stitching.

5. The protective headwear of claim 1, wherein the pocket band is separately formed and stitched to the body by the base stitching.

6. The protective headwear of claim 1, wherein the body has a first thickness and at least one wall of the pocket band has a second thickness reduced from the first thickness.

7. The protective headwear of claim 1, wherein the body provides a first level of stretchability and the pocket band provides a second level of stretchability.

8. The protective headwear of claim 1, wherein the body provides a first level of stretchability, a first portion of the pocket band provides a second level of stretchability, and a second portion of the pocket band associated with the stretchable opening provides a third level of stretchability.

9. The protective headwear of claim 1, wherein at least one pocket of the plurality of pockets is defined by the base stitching and a plurality of side stitchings, the plurality of side stitchings configured to approximate the protective insert.

10. The protective headwear of claim 1, wherein at least one protective insert of the plurality of protective inserts comprises a plurality of sealed air pockets configured to absorb and disperse an impact about the at least one protective insert.

11. The protective headwear of claim 1, wherein a protective insert comprises:

a hard outer layer;

at least one pliable middle layer having at least one arrangement of openings that extend at least partially through the at least one pliable middle layer;

a pliable inner layer; and wherein the hard outer layer, the at least one pliable middle layer and the pliable inner layer are sealed such that the openings form sealed air pockets in the at least one pliable middle layer.

12. The protective headwear of claim 11, wherein the hard outer layer is made of a thermoplastic.

13. The protective headwear of claim 11, wherein the at least one pliable middle layer and the pliable inner layer are made of an elastomer or a rubber.

14. The protective headwear of claim 11, wherein the at least one pliable middle layer comprises:

a first layer having a first arrangement of first openings in the first layer; and a second layer having a second arrangement of second openings in the second layer;

wherein the second arrangement alternates with the first arrangement, such that the first openings and the second openings are approximately non-overlapping and cover a substantial portion of the protective insert to enhance the absorption and distribution of the impact about the protective insert.

15. The protective headwear of claim 1, wherein a protective insert comprises an adhesive layer disposed atop one of a first surface and a second surface of the protective insert.

16. The protective headwear of claim 15, wherein the adhesive layer is double-sided adhesive tape.

17. The protective headwear of claim 15, wherein the adhesive layer is double-sided adhesive material.

* * * * *

UNITED STATES PATENT AND TRADEMARK OFFICE

CERTIFICATE OF CORRECTION

PATENT NO. : 8,973,171 B2
APPLICATION NO. : 13/962568
DATED : March 10, 2015
INVENTOR(S) : Cleva It is certified that error appears in the above-identified patent and that said Letters Patent is hereby corrected as shown below:

In the specification

Column 7, line 47:

Now reads: "industrial activates"

Should read: -- industrial activities --

Column 7, line 57-58:

Now reads: "provided though the"

Should read: -- provided through the --

Column 9, line 30:

Now reads: "industrial activates"

Should read: -- industrial activities --

Column 10, line 49:

Now reads: "industrial activates"

Should read: -- industrial activities --

Signed and Sealed this
Fifth Day of January, 2016

Michelle K. Lee

Michelle K. Lee
*Director of the United States Patent and Trademark Office*